US011402177B2

(12) United States Patent
Cohen et al.

(10) Patent No.: US 11,402,177 B2
(45) Date of Patent: Aug. 2, 2022

(54) COMPOSITE GRID/SLAT-ARMOR

(71) Applicants: Michael Cohen, Yehuda (IL); Eliyahu Schwalm, Migdalim (IL)

(72) Inventors: Michael Cohen, Yehuda (IL); Eliyahu Schwalm, Migdalim (IL)

( * ) Notice: Subject to any disclaimer, the term of this patent is extended or adjusted under 35 U.S.C. 154(b) by 0 days.

(21) Appl. No.: 17/089,376

(22) Filed: Nov. 4, 2020

(65) Prior Publication Data

US 2021/0239432 A1 Aug. 5, 2021

(30) Foreign Application Priority Data

Dec. 3, 2019 (IL) ..... 271158

(51) Int. Cl.
*F41H 5/02* (2006.01)
*F41H 5/24* (2006.01)
*F41H 5/013* (2006.01)

(52) U.S. Cl.
CPC ..... *F41H 5/026* (2013.01); *F41H 5/013* (2013.01); *F41H 5/24* (2013.01)

(58) Field of Classification Search
CPC . F41H 5/026; F41H 5/013; F41H 5/24; F41H 5/0492
See application file for complete search history.

(56) References Cited

U.S. PATENT DOCUMENTS 1,385,897 A * 7/1921 Tresidder ..... F41H 5/023 114/9
4,328,955 A * 5/1982 Hermans ..... B63G 13/00 256/8
6,311,605 B1 * 11/2001 Kellner ..... F41H 5/007 89/36.02
7,819,050 B1 * 10/2010 MacDougall ..... F41H 7/04 89/36.17
8,141,470 B1 * 3/2012 Farinella ..... F41H 5/026 89/36.01
8,297,193 B1 * 10/2012 Lawson ..... F42B 8/24 102/498
8,539,873 B2 * 9/2013 Gonard ..... F41H 5/023 89/36.08
8,555,769 B2 * 10/2013 Hubsch ..... F41H 5/226 89/36.08
8,640,592 B1 * 2/2014 Gabrys ..... F41H 7/042 89/36.04
8,746,121 B2 * 6/2014 Hubsch ..... F41H 5/023 89/36.01
8,893,606 B2 * 11/2014 Gavish ..... F41H 7/00 89/36.02
9,003,945 B2 * 4/2015 Vallee ..... F41H 5/026 89/36.02
9,328,999 B1 * 5/2016 Kay ..... F41H 5/16
9,835,417 B1 * 12/2017 Kay ..... F41H 5/026
10,648,777 B2 * 5/2020 Bailey ..... F41H 5/0407
10,670,375 B1 * 6/2020 Cannon ..... F41H 7/044
(Continued)

*Primary Examiner* — Joshua E Freeman
(74) *Attorney, Agent, or Firm* — Foley & Lardner LLP

(57) ABSTRACT

This invention provides, in some aspects, for devices and methods for protecting a sensitive structure against explosive warhead containing weaponry, whereby a protective apparatus is positioned to be facing an anticipated impact direction at a spacing from said sensitive structure, wherein said apparatus absorbs the impact of said explosive warhead containing weaponry.

23 Claims, 16 Drawing Sheets

(56) References Cited

U.S. PATENT DOCUMENTS

2008/0164379 A1* 7/2008 Wartmann ..... F41H 11/02 245/8
2008/0257141 A1* 10/2008 Medwell ..... F41H 5/013 89/36.02
2009/0095147 A1* 4/2009 Tunis ..... F41H 5/013 89/36.02
2009/0217811 A1* 9/2009 Leeming ..... F41H 5/06 89/36.02
2009/0266227 A1* 10/2009 Farinella ..... F41H 5/026 89/36.02
2010/0288114 A1* 11/2010 Soukos ..... F41H 5/026 89/36.02
2010/0294124 A1* 11/2010 Wentzel ..... F41H 11/02 89/36.02
2011/0067561 A1* 3/2011 Joynt ..... F41H 5/023 89/36.02
2011/0079135 A1* 4/2011 Farinella ..... F41H 5/026 89/36.02
2011/0113952 A1* 5/2011 Rosenwasser ..... F41H 5/026 89/36.02
2011/0179944 A1* 7/2011 Farinella ..... F41H 5/023 89/36.02
2011/0203453 A1* 8/2011 Farinella ..... F41H 5/0492 89/36.02
2011/0232472 A1* 9/2011 Kellner, Jr. ..... F41H 5/026 89/36.08
2011/0252955 A1* 10/2011 Radstake ..... F41H 5/023 89/36.02
2011/0303817 A1* 12/2011 Adams ..... F41H 5/013 248/560
2012/0011993 A1* 1/2012 Malone ..... F41H 5/023 89/36.02
2012/0046916 A1* 2/2012 Farinella ..... F41H 5/023 703/1
2012/0137866 A1* 6/2012 Gonard ..... F41H 5/013 89/36.08
2012/0152101 A1* 6/2012 Engleman ..... F41H 5/023 89/36.08
2012/0180640 A1* 7/2012 Farinella ..... F41H 5/026 89/36.08
2012/0247316 A1* 10/2012 Farinella ..... F41H 5/013 89/36.02
2012/0291616 A1* 11/2012 Andrewartha ..... F41H 5/026 89/36.02
2013/0025441 A1* 1/2013 Lee ..... F41H 5/026 89/36.02
2013/0025442 A1* 1/2013 Lee ..... F41H 5/026 89/36.02
2013/0032026 A1* 2/2013 Shackelford ..... F41H 7/04 89/36.02
2013/0149103 A1* 6/2013 Stevenson ..... F41H 5/0478 415/9
2013/0263728 A1* 10/2013 Hebensperger ..... F41H 5/0414 89/36.02
2014/0041517 A1* 2/2014 Leeming ..... F41H 3/00 89/36.02
2014/0137728 A1* 5/2014 Chu ..... F41H 7/04 89/36.08
2014/0144312 A1* 5/2014 Svensson ..... F41H 5/02 89/36.02
2014/0224106 A1* 8/2014 Shackelford ..... F16B 19/00 89/36.02
2014/0338520 A1* 11/2014 Bourke ..... F41H 5/023 89/36.02
2015/0020678 A1* 1/2015 Hafer ..... F41H 5/026 89/36.02
2015/0226526 A1* 8/2015 Shoshan ..... F41H 5/00 89/36.02
2016/0177130 A1* 6/2016 Savage ..... F41H 5/0471 89/36.02
2016/0209178 A1* 7/2016 Bailey ..... F41H 5/0414
2016/0376803 A1* 12/2016 Monk ..... F41H 5/013 52/282.1
2017/0138703 A1* 5/2017 Wadley ..... B32B 5/24
2017/0241749 A1* 8/2017 Boviall ..... F41H 5/06
2017/0343321 A1* 11/2017 Park ..... F41H 5/013
2018/0306555 A1* 10/2018 Bannon ..... F41H 5/026
2019/0271170 A1* 9/2019 Fila ..... F41H 5/24

* cited by examiner

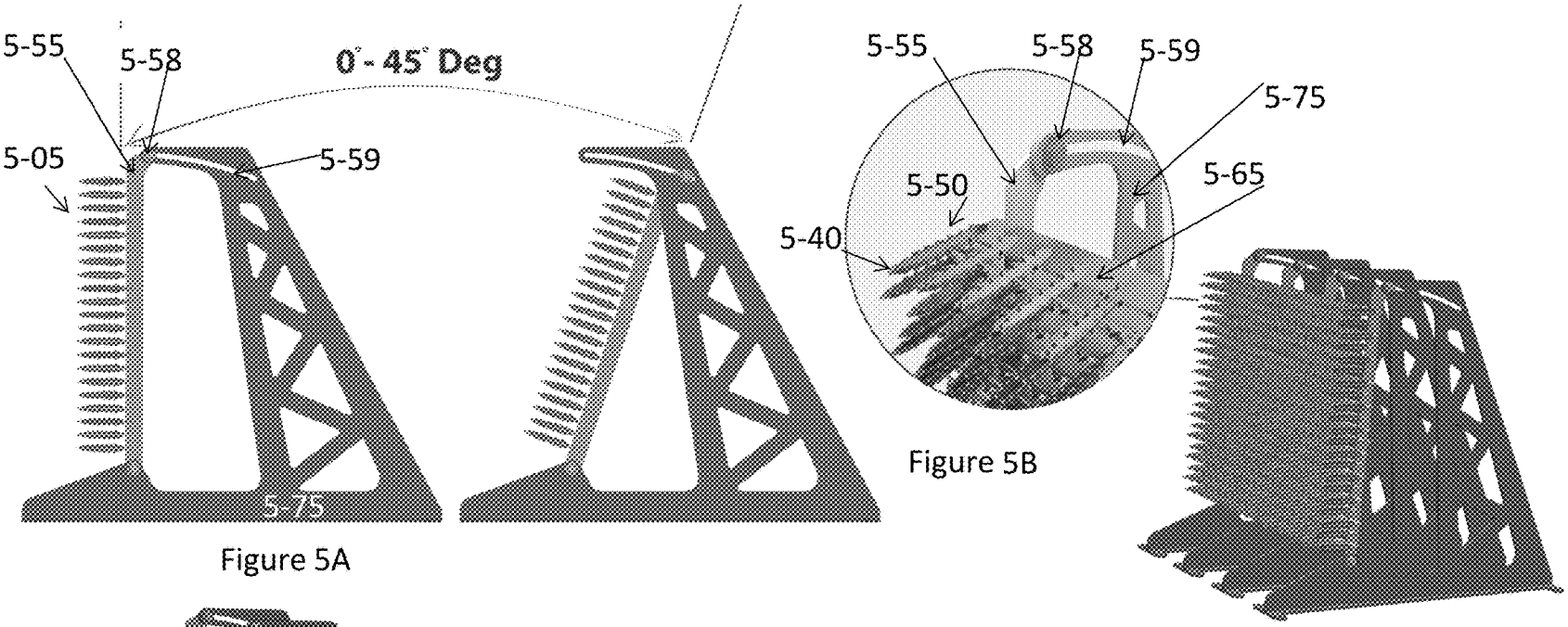
Figure 5A
Figure 5B
Figure 5C
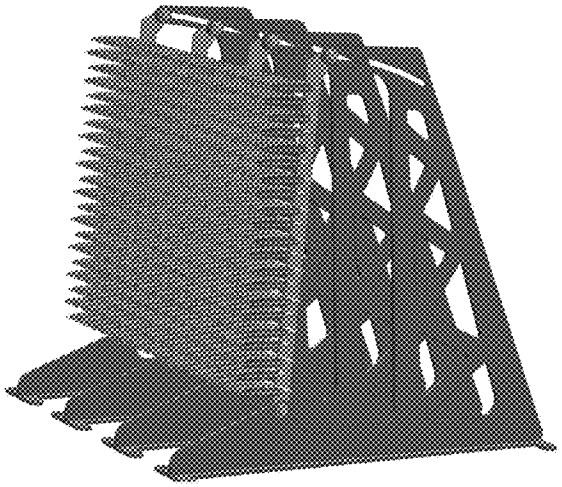
Figure 5D

Ceramic element
Composite material

Backup
LIBA

COMPOSITE GRID/SLAT-ARMOR

BACKGROUND OF THE INVENTION

Explosive warhead containing weaponry is an ever evolving problem facing humanity. Conventional and improvised devices cheap to manufacture and highly effective in terms of their capacity to devastate a wide array of targets including military bases, factories, bridges, ships, tanks, missile launching sites, artillery emplacements, fortifications, and troop concentrations.

As each type of target presents a different physical destruction problem, a variety of general and special-purpose warheads are required, within the bounds of cost and logistical availability, so that each target may be attacked with maximum effectiveness.

HEAT warheads were also developed during World War II, from extensive research and development into shaped charge warheads. The warhead functions by having the explosive charge collapse a metal liner inside the warhead into a high-velocity superplastic jet. This superplastic jet is capable of penetrating armor steel to a depth of seven or more times the diameter of the charge (charge diameters, CD) and its effect is purely kinetic in nature. The HEAT warhead has become somewhat less effective against tanks and other armored vehicles due to the use of composite armor, explosive-reactive armor, and active protection systems which destroy the HEAT warhead before it hits the tank although most of the solutions available result in too great a compromise between adequate protection and being sufficiently lightweight for reasonable protection of targets.

The Kornet or AT-14 Spriggan anti-tank guided missile (ATGM) intended for use against armored vehicles and fortifications. The Kornet missile contains tandem shaped charge HEAT warheads.

To provide at least partial protection against these weapons, bar or slat armor has been developed, and is in use on a number of military vehicles.

Slat or bar armor is known to typically include a series of rigid blades or a grid deployed around the target site, which can neutralize the warhead, either by deforming the conical liner, for example, in the case of a shaped charge or by short-circuiting the fuse mechanism of the warhead.

The slat or bar armor is disposed in a predetermined distance from the target, so as to allow the armor to come in contact with the cover of the warhead in order to neutralize it before the trigger hits the target body. The distance between the armor and the target body is known as the standoff. Unfortunately, should detonation occur as a consequence of the warhead being triggered on contact with the slat or bar, the added standoff space can in some cases, increase the penetration/damage, for example, by promoting better jet formation with a HEAT warhead.

While current slat or bar armor configurations were anticipated to provide an improved armor system for protection against high-velocity jets created by shaped charges, with current systems minimally effective at best against tandem charge HEAT missiles in particular and to date the promise remains unfulfilled and there is a great need for improved systems of defense to address these issues.

SUMMARY OF THE INVENTION

This invention provides, in some aspects, for devices and methods for protecting a sensitive structure against explosive warhead containing weaponry, whereby a protective apparatus is positioned to be facing an anticipated impact direction at a spacing from said sensitive structure, wherein said apparatus absorbs the impact of said explosive warhead containing weaponry. In some embodiments, according to this aspect, the protective apparatus faces an impact-absorbing direction in front, in back or on the sides of the sensitive structure. In some embodiments, according to this aspect, the protective apparatus faces an impact-absorbing direction above or below the sensitive structure. In some aspects, according to this aspect, the protective apparatus is supported by a framework that is independently secured and does not rely on load bearing supports of said sensitive structure.

This invention provides in some embodiments, a composite spiked grid/slat-armored apparatus for protection against explosive warhead containing weaponry. In some embodiments, the composite spiked grid/slat-armored apparatus is protective against tandem charge HEAT missiles, such as the Kornet tandem charge missile systems.

The composite spiked grid- or slat-armored apparatus of this invention will comprise, inter alia, a plurality of slat or bar units including: a strike end configured for facing an anticipated impact direction, each of the plurality of slat or bar units extending along a first longitudinal direction, the plurality of slat units separated from each other by a spacing, and further comprising a plurality of slat or bar cross-attachment supports substantially perpendicular to and connected to said plurality of slat or bar units extending along a first longitudinal direction, wherein said cross-attachment supports provide mutual support to said slats or bars to restrict expansion of said spacing by an incoming explosive warhead containing weapon.

In some aspects of this invention, the plurality of slat or bar units are arranged in two or more rows, each of said plurality of slat or bar units extending along a first longitudinal direction and including: a strike end configured for facing an anticipated impact direction, each of the plurality of slat or bar units separated from each other by a first spacing.

According to this aspect, and in some embodiments, the composite spiked grid- or slat-armored apparatus for protection against explosive warhead containing weaponry of this invention further comprises a plurality of spiked cross-attachment supports connected to and positioned along said plurality of slat or bar units such that a spiked surface of said cross attachment support is positioned substantially perpendicular to said first longitudinal direction, wherein said cross-attachment supports restrict expansion of said first spacing by an incoming explosive warhead containing weapon coming into contact therewith.

According to this aspect and in some embodiments, the plurality of slat or bar units and plurality of spiked cross-attachment supports form a trapping array, which trapping array is arranged within a first frame movably attached to a second framework structure, such that the trapping array may move in any lateral direction.

In some embodiments, and as referring to FIG. 1E of the drawings depicting one embodiment for exemplary purposes only, of an element of a trapping array of this invention, the array will comprise a plurality of slat or bar units 1-20, which contain a spiked surface 1-40 or spiked surfaces and may further contain a cross attachment support 1-25, further comprising a spiked surface 1-50.

In some embodiments, the cross attachment supports may be positioned/so constructed such that each support is connected to the slat and bar unit with which it is most nearly associated, i.e. connected on only one side of the support. In other embodiments, a physical connection may be provided between rows of cross-attachments supports, as well, to form a spiked grid-like structure.

It will be appreciated that any number of and arrangement of the cross attachments supports is envisioned, and contemplated herein, whereby spacing between the spiked surfaces is maintained ensuring and expansion of the first spacing by an incoming explosive warhead containing weapon coming into contact therewith is restricted, while entrapping an incoming explosive warhead containing weapon coming into contact therewith is promoted.

In some aspects, the strike end serves to face an anticipated impact direction and pierce the warhead structure coming into contact with same. In some embodiments, the slat or bar units extending along a first longitudinal direction have a modified impact facing end such that same may pierce or neutralize an incoming explosive warhead containing weapon coming into contact therewith.

In some aspects, the spiked cross-attachment supports have impact facing surfaces that may pierce or neutralize an incoming explosive warhead containing weapon coming into contact therewith. In some embodiments, the combined piercing surfaces of the strike end of the slat or bar units and spiked cross-attachment supports pierce or neutralize an incoming explosive warhead containing weapon coming into contact therewith.

In some embodiments, this invention provides a method of protecting a target against explosive warhead containing weaponry, comprising providing a composite spiked grid- or slat-armored apparatus this invention including any embodiment thereof as described herein, positioned to be facing an anticipated impact direction at a spacing from said target in need of protection.

In some embodiments, the first spacing between adjacent slat or bar units and/or between sharp protrusions of the strike end of adjacent slat or bar units in said array is from about 10% to about 70% less in size than a diameter of an incoming explosive warhead containing weaponry.

In some embodiments, the spacing between the adjacent slat or bar units and/or between the sharp protrusions of the strike end of adjacent slat or bar units are separated from each other by a first spacing, which spacing is such that a portion of the impacting end of the incoming explosive warhead containing weaponry inserts within same.

According to this aspect and in some embodiments, upon positioning of a portion of the impacting end of the incoming explosive warhead containing weaponry between the adjacent slat or bar units, the spiked cross-attachment supports connected to and positioned along the slat/bar units engage and structurally impact the portion of the incoming explosive warhead containing weaponry, by in some embodiments, piercing same and compromising the integrity of the warhead preventing or mitigating functional capacity of same.

When the threat is of a kind having a hollow envelope, such as for example, shaped-charge projectiles such as e.g. Kornet missiles, the spiked cross-attachment supports are configured for piercing this envelope for the purpose of neutralizing it. The spiked cross-attachment supports can be made of any appropriate material having sufficient toughness to penetrate the envelope of the incoming projectile upon its impact with a respective slat/bar.

The shape, dimensions and/or orientation of the spiked cross-attachment supports can vary in a direction away from the rear end. This varying can be such that the distance between the piercing elements of the top and bottom sets increase in the direction away from the rear end. The spiked cross-attachment supports can be outwardly tapered in order to increase their penetration capability into the incoming projectile.

The tapering angle between the spiked cross-attachment supports of a first set and second set, which together engage the incoming explosive warhead containing weaponry, may be constructed so as not to exceed 100°, more particularly not to exceed 80°, even more particularly not to exceed 60°, still more particularly not to exceed 45° and still more particularly not to exceed 40°.

In some embodiments, the spiked cross-attachment supports of a first set and second set, which together engage the incoming explosive warhead containing weaponry, may be constructed so as be aligned with one another. Alternatively, the spiked cross-attachment supports of a first set and second set, which together engage the incoming explosive warhead containing weaponry may be arranged at an offset.

In some embodiments, the spiked surface of said cross attachment support is positioned substantially perpendicular to said first longitudinal direction, wherein said cross-attachment supports restrict expansion of said first spacing by an incoming explosive warhead containing weapon coming into contact therewith.

It will be appreciated that sharp protrusions of the strike end of the slat or bar units of this invention, the spiked surfaces of the cross attachment supports of this invention or a combination thereof may structurally impact and may therefore be considered to be "disrupting elements", which in some aspects represent elements that pierce a portion of the incoming explosive warhead containing weapon and may therefore be referred to as a "piercing element" as well.

In other aspect, the plurality of slat or bar units and said plurality of spiked cross-attachment supports form a trapping array, which trapping array is arranged within a first frame movably attached to second framework structure, such that said trapping array may move in any lateral direction.

In some aspects, the slat or bar units, or spiked cross-attachment supports, or combination thereof are composed of various materials selected from the group consisting of: metals, ceramics, composites, and combinations thereof.

In some aspects, the spiked cross-attachment supports contain sharp extending projections and in some embodiments, the sharp extending projections may vary in terms of number, spacing, periodicity, angle, length, shape or a combination thereof In some embodiments, the slat or bar units, or said spiked cross-attachment supports, or a combination thereof are of various cross sections. In some aspects, the slat or bar units, or spiked cross-attachment supports, or a combination thereof are of various shapes selected from the group consisting of: rectangles, trapezoids, triangles, ovals, and cylinders.

In some aspects, the cross-attachment members are attached by methods selected from the group consisting of: tying, wrapping, braiding, gluing, welding, adhesion, fasteners, screws, nubs, clips, bands, and any combination thereof.

In some aspects, the composite spiked grid- or slat-armored apparatus of this invention further comprises attachments that pass around the parallel bars, attachments that pass through holes in the parallel bars, perpendicular parallel bar-to-parallel bar attachments, X-shaped attachments, attachments between every other parallel bar, or any combination thereof.

The strike end of the plurality of slat or bar units therefore, in some embodiments, is so configured so as to structurally compromise, such as, in some embodiments, pierce at least an outer structure of an incoming projectile containing a warhead in a manner that ideally neutralizes or disrupts the functioning of the warhead without detonating same.

In some embodiments, when the threat is of a kind having a hollow envelope, such as for example, hollow-charge projectiles such as e.g. RPGs, the disrupting elements are configured for piercing this envelope for the purpose of neutralizing it. The disrupting elements can be made of a ballistic material having sufficient toughness to penetrate the envelope of the incoming projectile upon its impact with a respective slat.

In some embodiments, in order to increase the penetration capability of the disrupting elements, at least a part of them can each be formed with a plurality of sharp edges, facilitating more efficient penetration thereof into the projectile. In particular, the disrupting elements can have a plurality of surfaces (either curved or planar) angled with respect to each other, with sharp edges formed at the intersection between two or more of said surfaces.

In some embodiments, the shape, dimensions and/or orientation of the disrupting elements can vary in a direction. In some embodiments, the disrupting elements can be outwardly tapered in order to increase their penetration capability into an incoming projectile.

In some embodiments, the tapering angle between the disrupting elements of the plurality of slat or bar units can be chosen not to exceed 100°, more particularly not to exceed 80°, even more particularly not to exceed 60°, still more particularly not to exceed 45° and still more particularly not to exceed 40°.

In some aspects, one or more of the disrupting elements can have an extension towards said anticipated impact direction which does not exceed twice the maximal width of the piercing element, thereby providing the disrupting elements with a required robustness to penetrate the envelope of the projectile.

In some embodiments, the plurality of slat or bar units piercing end can have a serrated or a saw-like design, with a succession of teeth extending along the longitudinal axis of the slat unit, the teeth constituting the disrupting elements.

In some aspects, the plurality of slat or bar units, and in some embodiments, the grid-like trapping surface formed of same, may further comprise a spacer layer between such slats or bars, being made of a material having a lower toughness and/or ballistic capability than that of each of the slats or bars. In some aspects, the spacer material can be a composite material while each of the bars or slats can be made of metal. The composite material can be made, for example, of any of the following: Polyester, vinyl ester and epoxy. The composite material can be encapsulated by a binding cover made of a fiber-reinforced resin. According to one particular example, the fiber reinforcement of the binding cover can be provided, e.g. by fiberglass.

In some aspects, the slats or bars and in some embodiments, grid-like trapping surface can be constructed to constitute an integral body and prepared, inter alia, via bolting, welding, adhesive material, external wrapping etc. as appropriate, and considering the material used in the construction of same.

In some embodiments the parallel bars are composed of various materials selected from the group consisting of: metals, ceramics, composites, and combinations thereof.

In some embodiments the parallel bars are of various cross sections and shapes selected from the group consisting of: rectangles, trapezoids, triangles, ovals, and circles.

In some embodiments the cross-attachment members are attached by methods selected from the group consisting of: tying, wrapping, braiding, gluing, welding, adhesion, fasteners, screws, nubs, clips, bands, and any combination thereof.

In some embodiments the cross-attachment members are configured in a manner selected from the group consisting of: attachments that pass around the parallel bars, attachments that pass through holes in the parallel bars, perpendicular parallel bar-to-parallel bar attachments, X-shaped attachments, attachments between every other parallel bar, and combinations of these.

It will be appreciated that the plurality of slat or bar units will be configured to include a spacing between each two neighboring bars/slats, so as to minimize the risk of the fuse of the incoming threat from impacting solid material and causing detonation of the hollow charge.

Surprisingly, it has now been found that protection from explosive warhead containing weaponry, in particular "shaped charge" weapons and the like may be achieved via the use of the slat- or bar- armor arrays as described herein, which can significantly and consistently reduce the impact of same, by structurally compromising same, so that even following detonation, the target is protected and/or minimally impacted by same.

The invention further provides, in some embodiments, a composite grid- or slat-armored apparatus for protection against explosive warhead containing weaponry, whereby the apparatus, in addition to comprising one or more disrupting elements as herein described, will further comprise a composite armor plate provided at a second spacing from said grid like trapping surface, distal to the surface of the plurality of slat or bar units facing an anticipated impact direction.

In some aspects, the composite armor plate comprises high density ceramic pellets or ceramic bodies, having a chemical content or geometry and size such that the arrangement of the pellets in an array serves to mitigate the kinetic energy-induced damage from explosive warhead containing weaponry.

Surprisingly, it has now been found that composite armor plates as herein described, when coupled with slat- or bar-armor arrays, when appropriately spaced, can significantly and consistently reduce the impact of same, even following detonation.

In some aspects, the composite armor plates as herein described may comprise any appropriate plate comprising high density ceramic pellets or ceramic bodies, for example as described in U.S. Pat. Nos. 5,763,813, 5,972,819, 6,203,908, 6,112,635, 6,408,734, 6,289,781, 6,624,106, 6,575,075, 6,497,966, 6,860,186, 7,117,780, 7,603,939, 8,281,700, 8,012,897, 7,383,762, or 7,402,541, each and every one of which is hereby incorporated herein in its entirety.

In some embodiments, the composite armor plates as herein described may comprise a single internal layer of high density ceramic pellets, said pellets having an $Al_2O_2O_3$ content of at least 93%, and a specific gravity of at least 2.5 and retained in panel form by a solidified material which is elastic at a temperature below 250° C.; the majority of said pellets each having a part of a major axis of a length of in the range of about 3-12 mm and being bound by said solidified material in a plurality of superposed rows.

In some embodiments, the composite armor plates as herein described specifically envisioned for incorporation include those as described in U.S. Pat. No. 5,972,819 or U.S. Pat. No. 7,603,939 or a combination thereof In some embodiments, the composite armor plates as herein described specifically envisioned for incorporation include those as described in U.S. Pat. Nos. 5,972,819, 6,112,635, 7,603,939, 8,281,700, 8,012,897, 7,402,541, 7,383,762 or any combination thereof.

In some aspects, when combining aluminum oxide with other oxides within specific parameter ratios, there is achieved an exceptional rise in the homogenity of the produced product in terms of parametric tolerance based on crush point studies of geometric bodies produced therefrom after sintering. Thus, it has been found that by using raw materials in which the chemical compositions fall within a specific range and forming them into geometric sintered shapes, homogeneity of performance and quantitatively and qualitatively superior activity is achieved.

In some embodiments, the composite armor plates as herein described may comprise a sintered, alumina ceramic product comprising about 90-97.5 w/w % $Al_2O_3$, about 0.5-1.0 w/w % MgO, about <0.05-1.0 w/w % $SiO_2$, about 4.5-7.5 w/w % $ZrO_2$ and about 0.07-0.13 w/w % $HfO_2$.

In some embodiments, the composite armor plates as herein described may comprise a sintered, alumina ceramic product, comprising at least 0.585 w/w % MgO, 90 w/w % $Al_2O_3$, <0.05 w/w % $SiO_2$, 4.5 w/w % $ZrO_2$ and 0.075 w/w % $HfO_2$.

In some embodiments, the composite armor plates as herein described may comprise a sintered, alumina ceramic products according to the present invention, comprise up to 1.0 w/w % MgO, 97.5 w/w % $Al_2O_3$, 1 w/w % $SiO_2$, 7.5 w/w % $ZrO_2$ and 0.125 w/w % $HfO_2$.

In some embodiments, the composite armor plates as herein described may comprise a sintered, alumina ceramic product, comprising about 0.6 w/w % MgO, 93 w/w $Al_2O_3$, <0.05 w/w $SiO_2$, 6 w/w % $ZrO_2$ and 0.1 w/w % $HfO_2$.

In some embodiments, the composite armor plates can preferably include further minor amounts of additional oxides, selected from the group consisting of $Na_2O$, $P_2O_5$, $K_2O$, CaO, $TiO_2$, $Fe_2O_3$, CuO, ZnO, BaO, $Y_2O_3$ and mixtures thereof.

In some embodiments, the composite armor plates as herein described may comprise a sintered, alumina ceramic product comprising about 0.6 w/w % MgO, 92.62 w/w $Al_2O_3$, <0.05 w/w % $SiO_2$, 6 w/w % $ZrO_2$, 0.1 w/w % $HfO_2$, 0.2 w/w % $Na_2O$, 0.02 w/w % $P_2O_5$, 0.01 w/w % $K_2O$, 0.1 w/w % CaO, 0.01 w/w % $TiO_2$, 0.02 w/w % $Fe_2O_3$, 0.2 w/w % CuO, 0.02 w/w % ZnO, 0.5 w/w % BaO, and 0.04 w/w $Y_2O_3$.

In some embodiments, the composite armor plates as herein described may comprise a sintered, alumina product comprising about 90-97.5 w/w $Al_2O_3$, about 0.5-1.0 w/w % MgO, about <0.05-1.0 w/w % $SiO_2$, about 4.5-7.5 w/w % $ZrO_2$ and about 0.07-0.13 w/w % $HfO_2$.

In some embodiments, the composite armor plates as herein described may comprise an armor panel comprising a single internal layer of high density ceramic pellets which are directly bound and retained in plate form by a solidified material such that the pellets are arranged in a single layer of adjacent rows and columns wherein a majority of each of said pellets is in direct contact with at least six adjacent pellets, wherein each of said pellets is made from a sintered, alumina product comprising about 90-97.5 w/w $Al_2O_3$, about 0.5-1.0 w/w % MgO, about <0.05-1.0 w/w % $SiO_2$, about 4.5-7.5 w/w % $ZrO_2$ and about 0.07-0.13 w/w % $HfO_2$ and there is less than a 30% difference between the crushing point of adjacent pellets.

In some embodiments, the composite armor plates as herein described may comprise a layer of a plurality of high density alumina ceramic bodies, each of said bodies being substantially cylindrical in shape, with at least one convexly curved end face, and each of said bodies having a major axis substantially perpendicular to the axis of its respective curved end face, wherein the ratio D/R between the diameter D of each of said cylindrical bodies and the radius R of curvature of the respectively convexly curved end face of each of said bodies is at least 0.64:1, and wherein said bodies are arranged in a plurality of adjacent rows and columns, the major axis of said bodies being in substantially parallel orientation with each other and substantially perpendicular to an adjacent surface of said panel; wherein a majority of each of said pellets is in contact with at least 4 adjacent pellets, the weight of said panel does not exceed 45 kg/M2.

In some embodiments, the composite armor plates as herein described may comprise a single internal layer of high density ceramic pellets which are directly bound and retained in plate form by a solidified material such that the pellets are arranged in a single layer of adjacent rows and columns wherein a majority of each of said pellets is in direct contact with at least six adjacent pellets, wherein each of said pellets is made from a sintered, alumina product comprising about 90-93 w/w $Al_2O_3$, about 0.5-1.0 w/w % MgO, up to about [<] 1.0 w/w % $SiO_2$, about 4.5-7.5 w/w % $ZrO_2$ and about 0.07-0.13 w/w % $HfO_2$ and there is less than a 30% difference between the crushing point of adjacent pellets.

In some embodiments, the composite armor plates as herein described may comprise a single internal layer of high density ceramic pellets which are directly bound and retained in plate form by a solidified material such that the pellets are bound in a plurality of adjacent rows, wherein the pellets have an $Al_2O_3$ content of at least 93% and a specific gravity of at least 2.5, the majority of the pellets each have at least one axis of at least 12 mm length, said one axis of substantially all of said pellets being in substantially parallel orientation with each other and substantially perpendicular to an adjacent surface of said plate, and wherein a majority of each of said pellets is in direct contact with six adjacent pellets and said solidified material and said plate are elastic.

In some embodiments, the composite armor plates as herein described may comprise a single internal layer of pellets which are directly bound and retained in plate form by a solidified material such that the pellets are bound in a plurality of adjacent rows, characterized in that the pellets have a specific gravity of at least 2 and are made of a material selected from the group consisting of glass, sintered refractory material, ceramic material which does not contain aluminum oxide and ceramic material having an aluminum oxide content of not more than 80%, the majority of the pellets each have at least one axis of at least 3 mm length and are bound by said solidified material in said single internal layer of adjacent rows such that each of a majority of said pellets is in direct contact with at least 6 adjacent pellets in the same layer to provide mutual lateral confinement therebetween, said pellets each have a substantially regular geometric form and said solidified material and said plate are elastic.

In some embodiments, the composite armor plates as herein described may comprise a layer of a plurality of high density alumina ceramic bodies, each of said bodies being substantially cylindrical in shape, with at least one convexly curved end face, and each of said bodies having a major axis substantially perpendicular to the axis of its respective curved end face, wherein the ratio D/R between the diameter D of each of said cylindrical bodies and the radius R of curvature of the respectively convexly curved end face of each of said bodies is at least 0.64:1, and wherein said bodies are arranged in a plurality of adjacent rows and columns, the major axis of said bodies being in substantially parallel orientation with each other and substantially perpendicular to an adjacent surface of said panel; wherein a majority of each of said pellets is in contact with at least 4 adjacent pellets, the weight of said panel does not exceed 45 kg/M2.

In some embodiments, the composite armor plates as herein described may comprise a single internal layer of high density ceramic pellets which are directly bound and retained in plate form by a solidified material such that the pellets are arranged in a single layer of adjacent rows and columns wherein a majority of each of said pellets is in direct contact with at least six adjacent pellets, wherein each of said pellets is made from a sintered, alumina product comprising about 90-93 w/w Al2O3, about 0.5-1.0 w/w % MgO, up to about [<] 1.0 w/w % SiO2, about 4.5-7.5 w/w % ZrO2 and about 0.07-0.13 w/w % HfO2 and there is less than a 30% difference between the crushing point of adjacent pellet.

In some embodiments, the composite armor plates as herein described may comprise a single internal layer of high density ceramic pellets which are directly bound and retained in plate form by a solidified material such that the pellets are bound in a plurality of adjacent rows, wherein the pellets have an Al2O3 content of at least 93% and a specific gravity of at least 2.5, the majority of the pellets each have at least one axis of at least 12 mm length., said one axis of substantially all of said pellets being in substantially parallel orientation with each other and substantially perpendicular to an adjacent surface of said plate, and wherein a majority of each of said pellets is in direct contact with six adjacent pellets and said solidified material and said plate are elastic.

In some embodiments, the composite armor plates as herein described may comprise a single internal layer of pellets which are directly bound and retained in plate form by a solidified material such that the pellets are bound in a plurality of adjacent rows, characterized in that the pellets have a specific gravity of at least 2 and are made of a material selected from the group consisting of glass, sintered refractory material, ceramic material which does not contain aluminum oxide and ceramic material having an aluminium oxide content of not more than 80%, the majority of the pellets each have at least one axis of at least 3 mm length and are bound by said solidified material in said single internal layer of adjacent rows such that each of a majority of said pellets is in direct contact with at least 6 adjacent pellets in the same layer to provide mutual lateral confinement therebetween, said pellets each have a substantially regular geometric form and said solidified material and said plate are elastic.

In some embodiments, the pellets are formed of a ceramic material selected from the group consisting of sintered oxide, nitrides, carbides and borides of alumina, magnesium, zirconium, tungsten, molybdenum, titanium and silica.

In some embodiments, each of the pellets is formed of a material selected from the group consisting of alumina, boron carbide, boron nitride, titanium diboride, silicon carbide, silicon oxide, silicon nitride, magnesium oxide, silicon aluminum oxynitride and mixtures thereof.

In some embodiments, the armor panel consists essentially of a single internal layer of a plurality of high density ceramic bodies directly bound and retained in panel form by a solidified material, having a specific gravity of at least 2 and being made of a material selected from the group consisting of ceramic material which does not contain aluminum oxide and ceramic material having an aluminum oxide content of not more than 80%, wherein each of the bodies are substantially cylindrical in shape, with at least one convexly curved end face, and each of the bodies have a major axis substantially perpendicular to the axis of its respective curved end face, wherein the ratio D/R between the diameter D of each of the cylindrical bodies and the radius R of curvature of the respectively convexly curved end face of each of the bodies is at least 0.64:1, and wherein the bodies are arranged in a plurality of adjacent rows and columns, the major axis of said bodies being in substantially parallel orientation with each other. with the outer surface facing the impact side and ceramic bodies are arranged in a plurality of adjacent rows, the cylinder axis of said bodies being substantially parallel with each other and perpendicular to the surfaces of the panel with the convexly curved end faces directed to the outer surface and the composite armor further comprising an inner layer adjacent the inner surface of said panel, where the inner layer is formed from a plurality of adjacent layers, each layer comprising a plurality of unidirectional coplanar anti-ballistic fibers embedded in a polymeric matrix, the fibers of adjacent layers being at an angle of between about 45° to 90° to each other.

In other embodiments, the panel is provided with a layer of a plurality of high density ceramic bodies, having a specific gravity of at least 2 and being made of a material selected from the group consisting of ceramic material which does not contain aluminum oxide and ceramic material having an aluminum oxide content of not more than 80%, each of said bodies being substantially cylindrical in shape, with at least one convexly curved end face, and each of said bodies having a major axis substantially perpendicular to the axis of its respective curved end face, wherein the ratio D/R between the diameter D of each of said cylindrical bodies and the radius R of curvature of the respectively convexly curved end face of each of said bodies is at least 0.64:1, and wherein said bodies are arranged in a plurality of adjacent rows and columns, the major axis of said bodies being in substantially parallel orientation with each other and substantially perpendicular to an adjacent surface of said panel.

This invention provides, in some embodiments, an armor system for defeating missile-borne and stationary shaped charges directed against a desired target.

This invention provides, in some embodiments, this invention in particular provides a superior armor system for defeating missile-borne and stationary shaped charges provided in tandem, as directed against a desired target.

In some embodiments, the target is a fixed target of strategic importance, such as a bridge, a communications structure or plant, a building, a reactor or other sensitive stationary target. In some embodiments, the target is a moving target, such as a ship or vehicle.

According to this aspect, and in some embodiments, the target may be located on land or in a body of water, in a fixed or temporary manner.

In some embodiments, the armor system specifically defeats missiles having a shaped charge or other explosive warhead. The armor system includes slat or bar units including: a strike end configured for facing an anticipated impact direction located outside of, and spaced away from, the composite armor plate, which is proximal to the outer surface of the target site. Such armor system slat or bar units form a grid-like trapping surface, being disposed to engage and disrupt the proper functioning of the explosive warhead, e.g. by interfering with an electrical firing mechanism of the tip-mounted fuze or structurally sabotaging the explosive device to prevent or interfere with efficient firing, e.g. of a shaped charge, to attenuate a high velocity jet emanating from an exploded missile and/or a stationary shaped charge.

In some embodiments, the armor system defeats a rocket propelled grenade directed at a target, whereby a rocket propelled grenade of the type having a forward conical section and a tip-mounted piezoelectric fuse component encounters the strike end configured for facing an anticipated impact direction of the armor system slat or bar units located outside of, and spaced away from the composite armor plate, which is proximal to the outer surface of the target site.

In some embodiments, the target is a stationary structure and in some embodiments, the target is mobile or under certain circumstances is mobile.

Such armor system slat or bar units form a grid-like trapping surface, being disposed to engage and disrupt the proper functioning of the explosive warhead, e.g. by engaging and deforming the conical section of the missile to short-circuit the fuse component.

In some embodiments, this invention provides a method of defeating missile-borne and stationary shaped charges directed at a target such as a building, bridge, ship, or vehicle, the missile of the type having a conical forward portion, relative to its trajectory, and a tip-mounted electric fuse component, where in some embodiments, the vehicle or ship has a hull with an outer surface, or the building or structure has an outer surface that can come into contact with the missile-borne and stationary shaped charge, where the method includes the steps of interposing a grid layer comprised of a net or spaced bar/slat configuration in the missile trajectory spaced from the outer surface of the target, e.g. the building, bridge, ship, or vehicle, the grid layer having a grid mesh size to engage the conical section to short circuit the fuze on a missile not detonating on the grid layer.

It will be appreciated that the term "bridge" as referred to herein is meant to be understood to encompass any structure that is so constructed so as to span across a desired space or length. For example, and in some embodiments, a bridge may span a body of water, or in some embodiments, a bridge may span over a land region of interest, and may be considered in some aspects, to be synonymous, as well with the term "overpass".

In some aspects, the composite grid- or slat-armored apparatus of this invention further comprises a composite armor plate provided at a second spacing from the grid layer, for example containing at least one layer of high density ceramic bodies or pellets, configured such that a jet formed by a missile detonating on the grid layer next encounters the layer of high density ceramic bodies or pellets; deflecting or otherwise attenuating the deflected jet.

In some embodiments, this invention provides a method of defeating missile-borne and stationary shaped charges directed at a target such as a building, bridge, ship, or vehicle, the missile of the type having a conical forward portion, relative to its trajectory, and a tip-mounted electric fuse component, where in some embodiments, the vehicle or ship has a hull with an outer surface, or the building or structure has an outer surface that can come into contact with the missile-borne and stationary shaped charge, where the method includes the steps of interposing an impact-dissipating structure in the missile trajectory spaced from the outer surface of the target, e.g. the building, bridge, ship, or vehicle, the impact-dissipating structure engaging the shaped charges and providing sufficient distance to specifically reduce the damage caused by the detonation of same.

According to this aspect and in some embodiments, the invention specifically contemplates a method of protecting a bridge against explosive warhead containing weaponry, by providing a protective apparatus positioned to be facing an anticipated impact direction at a spacing from the bridge, wherein the apparatus absorbs the impact of said explosive warhead containing weaponry.

According to this aspect and in some embodiments, the apparatus is supported on a framework that is independently secured and does not rely on load bearing supports of said bridge.

In some aspects of the invention, there is provided a method of protecting any desired target structure, against explosive warhead containing weaponry, by providing a protective apparatus positioned to be facing an anticipated impact direction at a spacing from the bridge, wherein the apparatus absorbs the impact of said explosive warhead containing weaponry, where the protective apparatus is supported on a framework that is independently secured and does not rely on load bearing supports of the desired target structure. For example, and representing an embodiment of this invention, it is specifically contemplated that this invention protects a desired target structure located in a body of water, and protection against an explosive warhead containing weaponry is provided by positioning a protective apparatus to be facing an anticipated impact direction at a spacing from the desired target structure, where for example, the protective apparatus is secured to a buoy, or other framework secured structure that maintains the ability to absorb the impact of said explosive warhead containing weaponry while being independently supported from a supporting structure of the desired target structure.

In some embodiments, there is provided a method of protecting any desired target structure, against explosive warhead containing weaponry, by providing a protective apparatus as described herein, further comprising a covering obscuring the desired target structure, for example, from being photographed by any means (e.g. drones, satellites, etc.) or in some embodiments, by being subject to impact from explosive warhead containing weaponry from more than one direction, e.g. whereby said covering is a roof over the desired structure, wherein such roof may as well be of a similar impact-neutralizing structure as described herein for the trapping array.

According to this aspect and in some embodiments, the apparatus is a composite spiked grid- or slat-armored apparatus as herein described or in some embodiments, the apparatus is a composite armor plate as herein described.

In some embodiments, the composite armor plate may comprise a fiber-reinforced matrix.

In embodiments of the invention the fiber in the fiber-reinforced matrix may consist essentially of a material selected from the group consisting of: poly-paraphenylene terephthalamide, stretch-oriented high density polyethylene, stretch-oriented high density polypropylene, stretch-oriented high density polyester, a polymer based on pyridobisimidazole, and silicate glass. Presently preferred embodiments of the invention include fiber-reinforced materials having high density stretch-oriented polypropylene fibers consolidated by heat and pressure in a lower density polypropylene polymer.

The accompanying drawings, which are incorporated in and constitute a part of this specification, illustrate several embodiments of the invention and together with the description, serve to explain the principles of the invention.

The invention will now be described in connection with certain preferred embodiments with reference to the following illustrative figures so that it may be more fully understood.

With reference now to the figures in detail, it is stressed that the particulars shown are by way of example and for purposes of illustrative discussion of certain embodiments of the present invention only, and are presented in the cause of providing what is believed to be useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may, be embodied in practice.

BRIEF DESCRIPTION OF THE DRAWINGS

Various embodiments of the composite grid- or slat-armored apparatuses of this invention are described herein with reference to the figures wherein:

FIGS. 5A-5D schematically another embodied aspect of the composite spiked grid- or slat-armored apparatus, highlighting the potential for the plurality of slat or bar units and the plurality of spiked cross-attachment supports arranged within a first frame movably attached to second framework structure to move in any lateral direction to optimize interaction of the incoming explosive warhead containing weaponry with disruptive elements of the apparatus.

FIG. 6A schematically depicts further embodied aspects of the invention, whereby the arrangement of the ceramic bodies/pellets 6-90 are shown in greater detail. FIG. 6B further demonstrates the ability to position yet a further composite armor plate positioning from the impact receiving surface.

DETAILED DESCRIPTION OF THE INVENTION

Figure 1A:
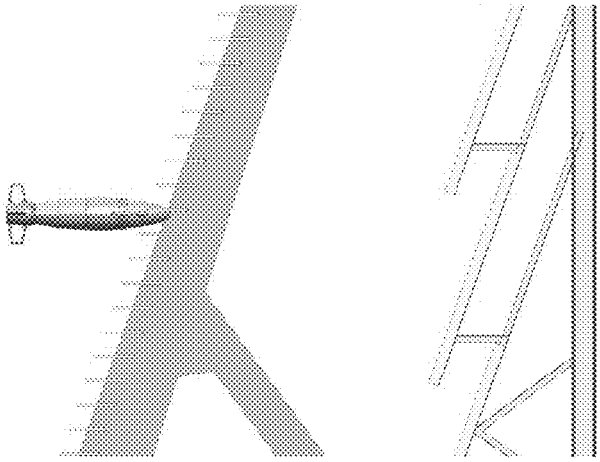
FIG. 1A-1D provide schematic, cross-sectional views depicting performance of the composite grid- or slat-armored system outer portion showing a plurality of slat or bar units including: a strike end configured for facing an anticipated impact direction, with incident RPG-type missile warheads having conventional piezoelectric fuses, with the engagement of the RPG-type missile with one of the extending surfaces of a slat causing detonation of the warhead creating a blast region through the slat or bar units.
Figure 1B:
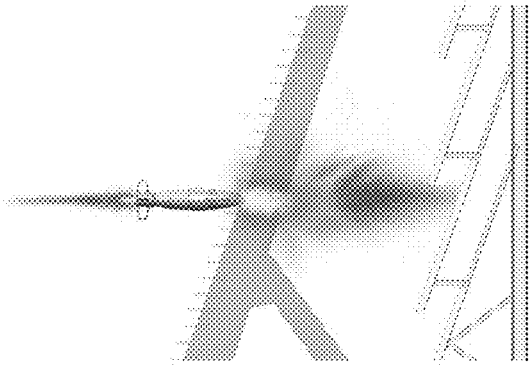
Figure 1C:
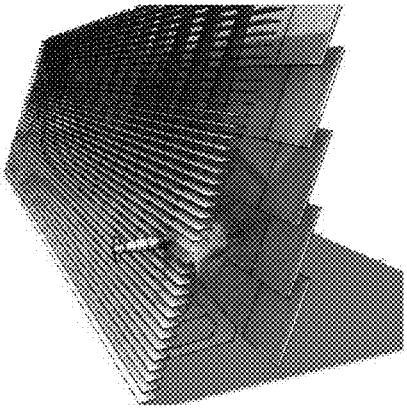
Figure 1D:
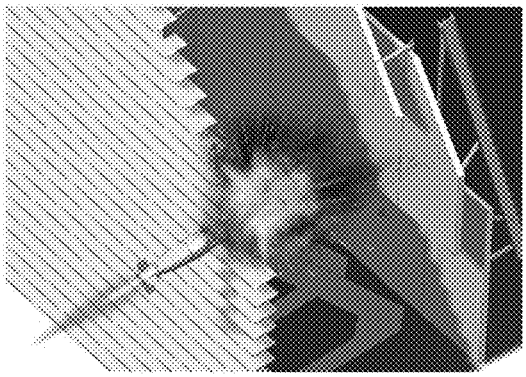

This invention provides, in some aspects, apparatuses and methods for protecting sensitive structures against explosive warhead containing weaponry. In some aspects, this invention provides for a one or more protective apparatuses being positioned to be facing an anticipated impact direction at a spacing from a sensitive structure, wherein the apparatus absorbs the impact of explosive warhead containing weaponry.

In some embodiments, according to this aspect, the one or more protective apparatuses faces an impact-absorbing direction in front, in back or on the sides of the sensitive structure.

In some embodiments, according to this aspect, the one or more protective apparatuses faces an impact-absorbing direction above or below the sensitive structure.

In some aspects, according to this aspect, the one or more protective apparatuses is supported by a framework that is independently secured and does not rely on load bearing supports of said sensitive structure.

This invention provides, in some embodiments, a composite grid- or slat-armored apparatus for protection against explosive warhead containing weaponry, comprising an impact facing surface containing a plurality of slat or bar units arranged to extend along a first longitudinal direction, the plurality of slat units separated from each other by a spacing and a plurality of slat or bar cross-attachment supports substantially perpendicular to and connected to the slat or bar units extending along a first longitudinal direction, providing mutual support to the slats or bars to restrict expansion of the spacing by an incoming explosive warhead containing weapon, wherein the plurality of slat or bar units and plurality of slat or bar cross-attachment supports together form a grid-like trapping surface, and the apparatus further comprising a composite armor plate provided at a second spacing from the grid like trapping surface, with the composite armor plate comprising high density ceramic bodies or pellets.

In some aspects, the grid- or slat-armored apparatus comprises a basic framework structure, comprising a plurality of slat or bar units arranged to extend along a first longitudinal direction, the plurality of slat units separated from each other by a spacing and a plurality of slat or bar cross-attachment supports substantially perpendicular to and connected to the slat or bar units extending along a first longitudinal direction. The framework structure further comprises a series of sharp protrusions extending outwardly in the impact absorbing direction of the framework.

In some embodiments the composite spiked grid- or slat-armored apparatus for protection against explosive warhead containing weaponry, comprises:

a plurality of slat or bar units arranged in two or more rows, each of said plurality of slat or bar units extending along a first longitudinal direction and including: a strike end configured for facing an anticipated impact direction, comprising sharp protrusions separated from each other by a first spacing, and a plurality of spiked cross-attachment supports connected to and positioned along said plurality of slat or bar units such that a spiked surface of said cross attachment support is positioned substantially perpendicular to said first longitudinal direction, wherein said cross-attachment supports restrict expansion of said first spacing by an incoming explosive warhead containing weapon coming into contact therewith;

wherein said plurality of slat or bar units and said plurality of spiked cross-attachment supports form a trapping array, which trapping array is arranged within a first frame movably attached to second framework structure, such that said trapping array may move in any lateral direction; and a composite armor plate provided at a second spacing from said second framework structure, said composite armor plate comprising:

i. a layer of a plurality of high density alumina ceramic bodies, each of said bodies being substantially cylindrical in shape, with at least one convexly curved end face, and each of said bodies having a major axis substantially perpendicular to the axis of its respective curved end face, wherein the ratio D/R between the diameter D of each of said cylindrical bodies and the radius R of curvature of the respectively convexly curved end face of each of said bodies is at least 0.64:1, and wherein said bodies are arranged in a plurality of adjacent rows and columns, the major axis of said bodies being in substantially parallel orientation with each other and substantially perpendicular to an adjacent surface of said panel; or ii. a single internal layer of pellets made of ceramic material disposed in a plurality of spaced-apart rows and columns, which are bound and retained in plate form by an elastic material; a majority of said pellets having at least one convexly curved end face; an outer impact receiving major surface defined by said convexly curved end faces of said pellets for absorbing and dissipating kinetic energy from high-velocity projectiles; said convexly curved end faces of said pellets receiving impact from high-velocity projectiles and absorbing and dissipating kinetic energy therefrom; said pellets having a substantially regular polygonal outer surface with the corners of the polygon being eliminated to form rounded corners; a majority of each of said pellets being in direct contact with six adjacent pellets in the same layer to provide mutual lateral confinement there between to trap said high-velocity projectiles; a valley space being defined between three adjacent pellets, said valley space being substantially smaller than a valley space defined by three cylindrical pellets having a diameter the same as said polygonal pellets with rounded corners; and a plurality of said pellets defining an opening extending into said pellet from a surface opposite to said outer impact receiving convexly cured end face of said pellet to reduce the weight per area thereof.

In some embodiments, this invention provides a composite spiked grid- or slat-armored apparatus for protection against explosive warhead containing weaponry, comprising a plurality of slat or bar units arranged in two or more rows, each of said plurality of slat or bar units extending along a first longitudinal direction and including: a strike end configured for facing an anticipated impact direction, comprising sharp protrusions separated from each other by a first spacing, and a plurality of spiked cross-attachment supports connected to and positioned along said plurality of slat or bar units such that a spiked surface of said cross attachment support is positioned substantially perpendicular to said first longitudinal direction, wherein said cross-attachment supports restrict expansion of said first spacing by an incoming explosive warhead containing weapon coming into contact therewith;

wherein said plurality of slat or bar units and said plurality of spiked cross-attachment supports form a trapping array, which trapping array is arranged within a first frame movably attached to second framework structure, such that said trapping array may move in any lateral direction; and a composite armor plate provided at a second spacing from said second framework structure, said composite armor plate comprising a single internal layer of high density ceramic pellets, said pellets having an $Al_2O_3$ content of at least 93%, and a specific gravity of at least 2.5 and retained in panel form by a solidified material which is elastic at a temperature below 250° C.; the majority of said pellets each having a part of a major axis of a length of in the range of about 3-12 mm and being bound by said solidified material in a plurality of superposed rows; or a single internal layer of high density ceramic pellets which are directly bound and retained in plate form by a solidified material such that the pellets are arranged in a single layer of adjacent rows and columns wherein a majority of each of said pellets is in direct contact with at least six adjacent pellets, wherein each of said pellets is made from a sintered, alumina product comprising about 90-93 w/w % $Al_2O_3$, about 0.5-1.0 w/w % MgO, up to about [<] 1.0 w/w % $SiO_2$, about 4.5-7.5 w/w % $ZrO_2$ and about 0.07-0.13 w/w % $HfO_2$ and there is less than a 30% difference between the crushing point of adjacent pellets; or a single internal layer of high density ceramic pellets which are directly bound and retained in plate form by a solidified material such that the pellets are bound in a plurality of adjacent rows, wherein the pellets have an $Al_2O_3$ content of at least 93% and a specific gravity of at least 2.5, the majority of the pellets each have at least one axis of at least 12 mm length, said one axis of substantially all of said pellets being in substantially parallel orientation with each other and substantially perpendicular to an adjacent surface of said plate, and wherein a majority of each of said pellets is in direct contact with six adjacent pellets and said solidified material and said plate are elastic; or a single internal layer of pellets which are directly bound and retained in plate form by a solidified material such that the pellets are bound in a plurality of adjacent rows, characterized in that the pellets have a specific gravity of at least 2 and are made of a material selected from the group consisting of glass, sintered refractory material, ceramic material which does not contain aluminum oxide and ceramic material having an aluminum oxide content of not more than 80%, the majority of the pellets each have at least one axis of at least 3 mm length and are bound by said solidified material in said single internal layer of adjacent rows such that each of a majority of said pellets is in direct contact with at least 6 adjacent pellets in the same layer to provide mutual lateral confinement therebetween, said pellets each have a substantially regular geometric form and said solidified material and said plate are elastic.

Referring to FIGS. 1A-1D, a schematic, cross-sectional view depicting performance of the composite spiked grid- or slat-armored system is provided. Depicted in the Figures is an outer portion showing a plurality of slat or bar units including: a strike end configured for facing an anticipated impact direction, with incident RPG-type missile warheads having conventional piezoelectric fuses.

In some aspects, as described herein, the composite spiked grid- or slat-armored apparatus of this invention will be so constructed in anticipation of the type of threat against which armored defense is sought, and such consideration will reflect whether a stationary or mobile structure is being defended, among other considerations.

In some aspects, the spacing separating the slat or bar units arranged in two or more rows, including the spacing between the sharp protrusions from the strike end of the slat or bar units and/or the spacing between the plurality of spiked cross-attachment supports is larger than the expected radius/length taken up by the detonator on the incoming warhead-containing weapon/rocket yet smaller than the diameter of the warhead.

Figure 1E:
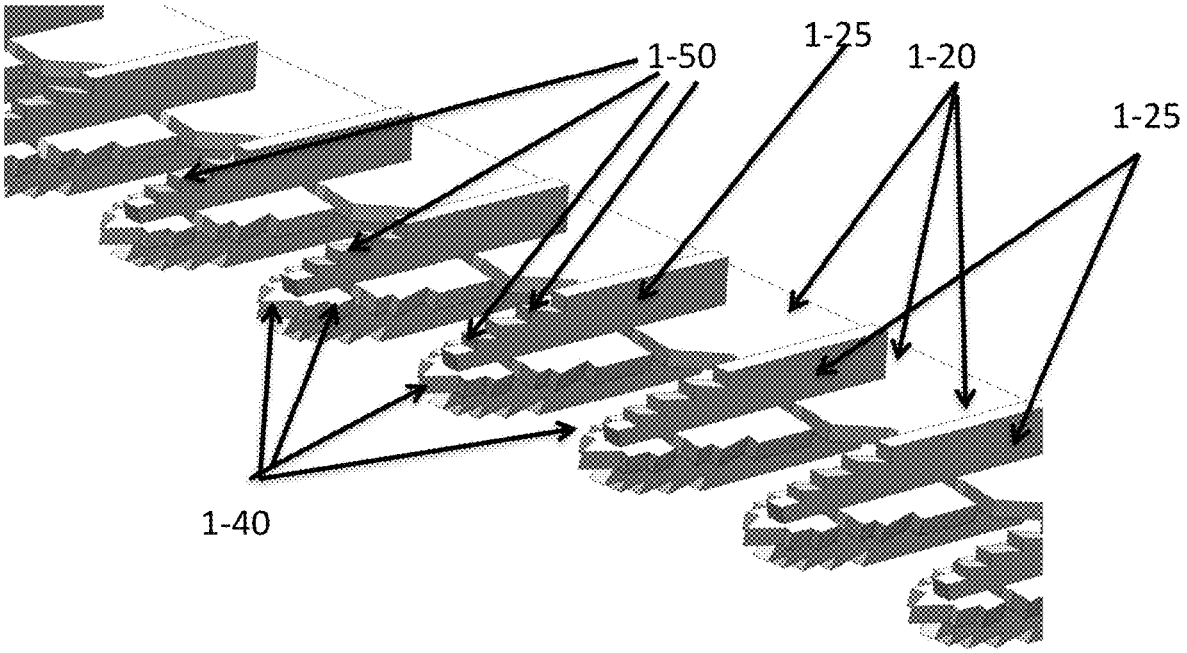
FIGS. 1E-1G provide additional schematic views of the embodied aspects of the composite spiked grid- or slat-armored apparatus of this invention in magnified view, where laterally extending spikes are shown from each support in the a first longitudinal direction and in the cross-attachment supports connected to and positioned substantially perpendicular to the first longitudinal direction. In parallel to the depictions in FIGS. 1A and 1D, FIGS. 1F and 1G depict the engagement of the RPG-type missile with one of the extending surfaces of a slat causing detonation of the warhead creating a blast region through the slat or bar units, which is limited by the reinforced structure provided at a spacing from the framework structure comprising the plurality of slat or bar units.

Referring to FIG. 1E, the plurality of slat or bar units arranged in two or more rows, each of said plurality of slat or bar units extending along a first longitudinal direction may be further adapted to contain such sharp protrusions 1-40 extending outwardly therefrom.

According to this aspect and in other embodiments the plurality of spiked cross-attachment supports connected to and positioned along the plurality of slat or bar units may be further constructed such that a spiked surface of said cross attachment support is positioned substantially perpendicular to said first longitudinal direction 1-50, so that spiked protrusions extend laterally from any direction. In some aspects, such spiked cross-attachments supports may be arranged in any periodicity about an axis in the framework structure, for example, to form a helical pattern, or any desired pattern, as will be appreciated by the skilled artisan.

For example, and representing certain embodiments of this invention, where a potential threat of an Indian anti-tank missile, such as a "MPATGM" may be encountered, the spacing may be optimized to protect thereagainst. According to this aspect, and in some embodiments, knowing that such missile diameter is typically 120 mm, and houses a detonator approximately 30 mm in length with an overall outer explosive cone diameter of about 50 mm, in some aspects, the first spacing distance would be envisioned to be about 45 mm, i.e. less than the diameter of the incoming explosive warhead, but larger than the expected size/length of the detonator contained therein.

It will be appreciated by the skilled artisan that the spacing distance can be adjusted and/or different arrangements can be prepared so that different missile threats can be best addressed, scaling same based on the considerations as described herein.

In some aspects, the spacing separating the slat or bar units arranged in two or more rows, including the spacing between the sharp protrusions from the strike end of the slat or bar units and/or the spacing between the plurality of spiked cross-attachment supports is from about 10% to about 70% less in size than a diameter of an incoming explosive warhead containing weaponry.

In some aspects, the so termed "second spacing" in particular with respect to the spacing between the composite armor plate and the framework structure bearing the plurality of slat or bar units and plurality of spiked cross-attachment supports is optimized in terms of its magnitude in consideration of the structure being protected, its magnitude, composition, etc. as well as the topography of the location of the structure being protected and the expected size of incoming weapon.

In some aspects, second spacing provides ample distance between the plurality of slat or bar units and plurality of spiked cross-attachment supports and the armor panels to reduce the influence of any potential detonation on contact with the impact surface of the apparatus being relayed to the protected structure whose placement is beyond the "second spacing" behind the armor.

In some aspects, the second spacing may also include providing additional spacing and a second, third, fourth, etc. composite armor plate, i.e. multiple or staggered or stacked composite armor plates, which in some embodiments may be more closely packed to the first composite armor plate to allow for greater protection of key targets.

In some embodiments, the armor panels substantially cover the exposed impact surface of a framework structure positioned at the second spacing. According to this aspect, and in some embodiments, the armor panels may be staggered to constitute overlapping segments, or may fully or substantially cover the protective panel comprising the armor in a more uniform, substantially single layer.

Figure 1F:
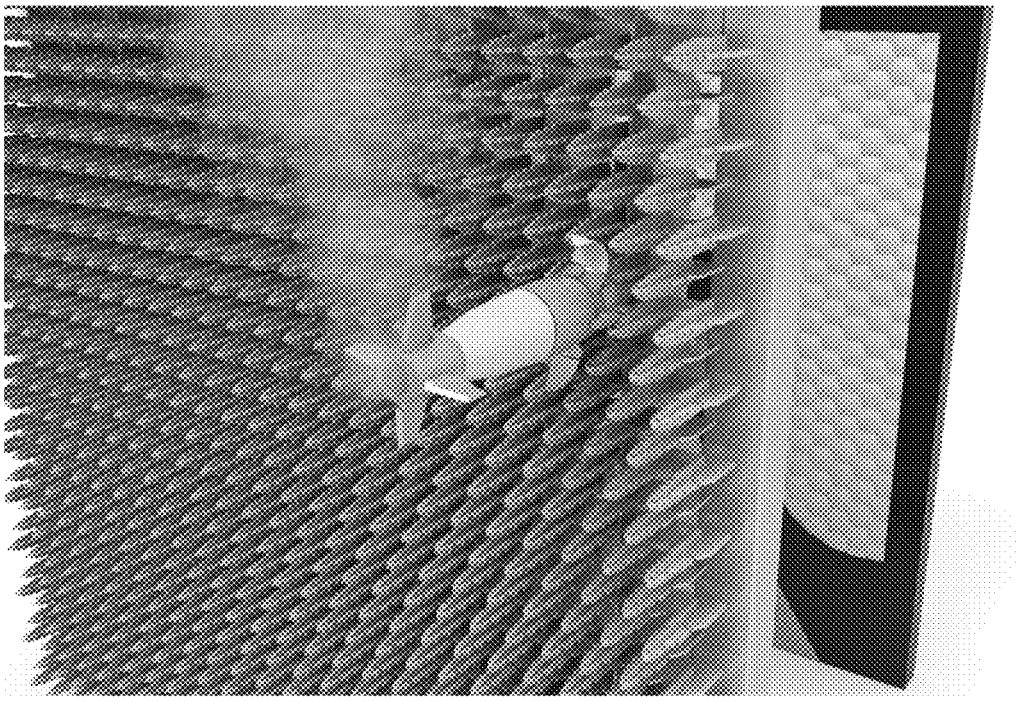
Figure 1G:
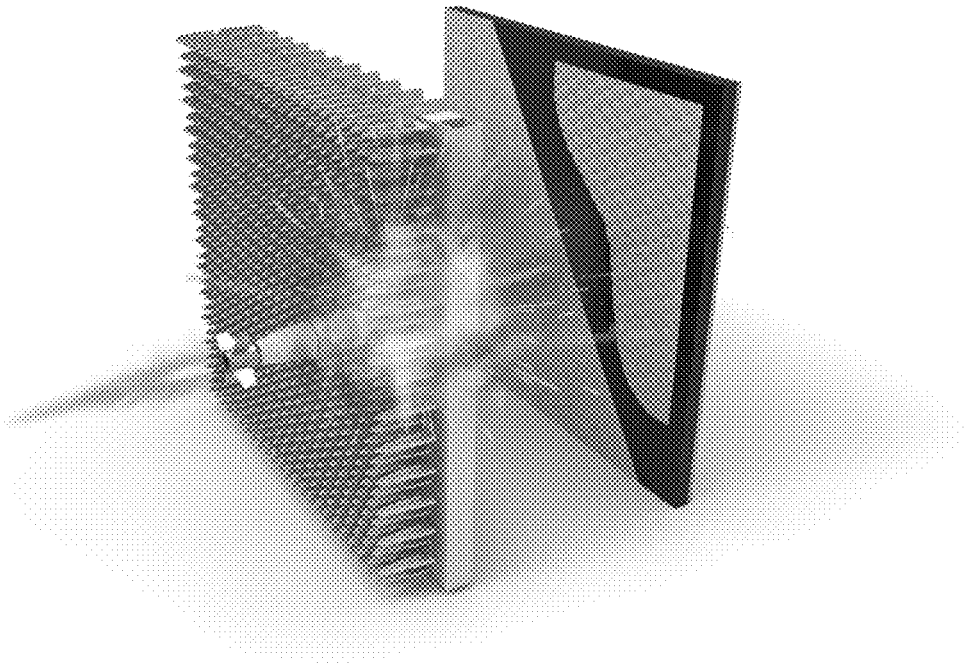

Referring to FIG. 1A, the engagement of the RPG-type missile with one of the extending surfaces of a slat engages and causes detonation of the warhead creating a blast region through the slat or bar units. In FIGS. 1A-1D, the composite armor plate is seen provided at a spacing from the grid like trapping surface, attenuating the activated jet. FIGS. 1E-1G provide additional schematic views of the embodied aspects of the composite spiked grid- or slat-armored apparatus of this invention. FIG. 1E highlights certain elements of the composite spiked grid- or slat-armored apparatus, where laterally extending spikes are shown from the support in the a first longitudinal direction, in particular extending from the sharp protrusions of same, and additional laterally extending spikes are provided in the cross-attachment supports connected to and positioned substantially perpendicular to the first longitudinal direction. In parallel to the depictions in FIGS. 1A and 1D, FIGS. 1F and 1G depict the engagement of the RPG-type missile with the extending surfaces of neighboring sharp protrusions, and trapping and neutralizing the missile and/or limiting the effect of the detonation of the warhead creating a blast region through the slat or bar units, which is limited by the reinforced structure provided at a spacing from the framework structure comprising the plurality of slat or bar units, respectively.

Figure 2:
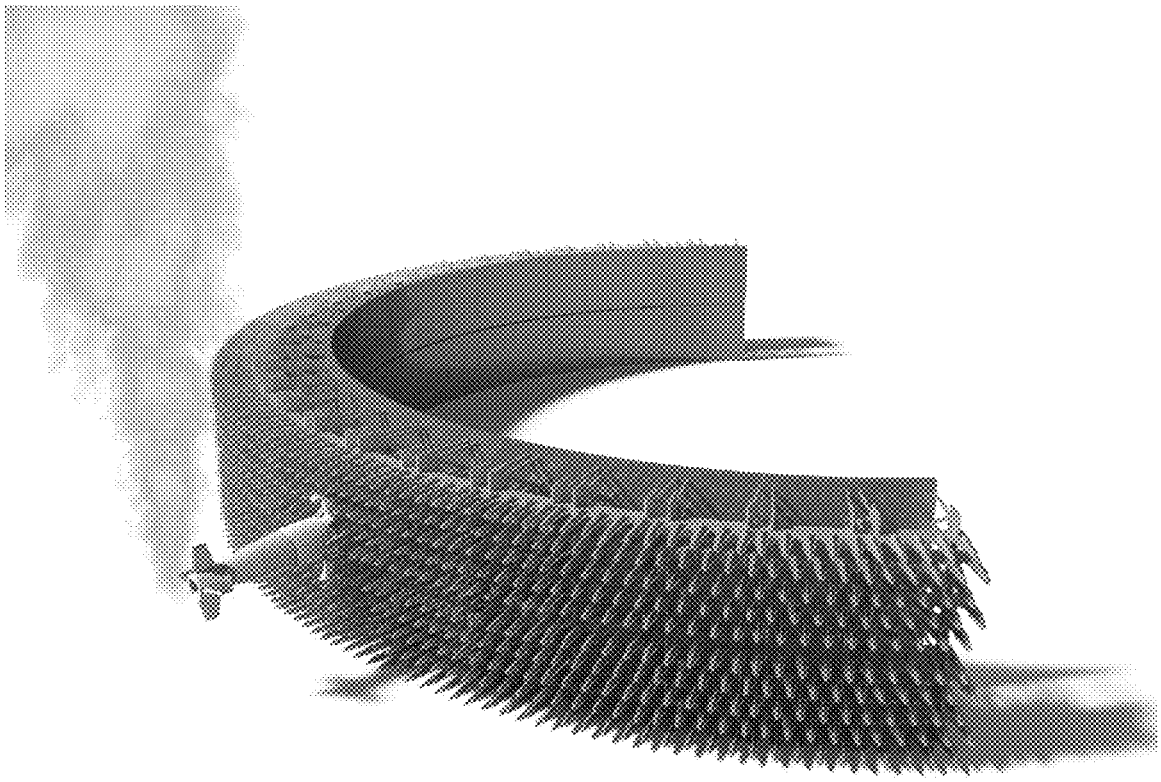
FIG. 2 schematically depicts another embodied aspect of the invention, depicting performance of the composite grid- or slat-armored system outer portion such that the plurality of slat or bar units including: a strike end configured for facing an anticipated impact direction, engages the RPG-type missile with one of the extending surfaces of a slat causing structural compromise to and preventing detonation of the warhead, where same is provided in a rounded framework structure.

FIG. 2 schematically depicts another embodied aspect of the invention, whereby a cross-sectional view depicting performance of the composite grid- or slat-armored system outer portion showing a plurality of slat or bar units including: a strike end configured for facing an anticipated impact direction, with incident RPG-type missile warheads having conventional piezoelectric fuses, as well. In this embodiment, the engagement of the RPG-type missile with one of the extending surfaces of a slat engages and causes structural compromise to the warhead, preventing detonation of the warhead.

Figure 3:
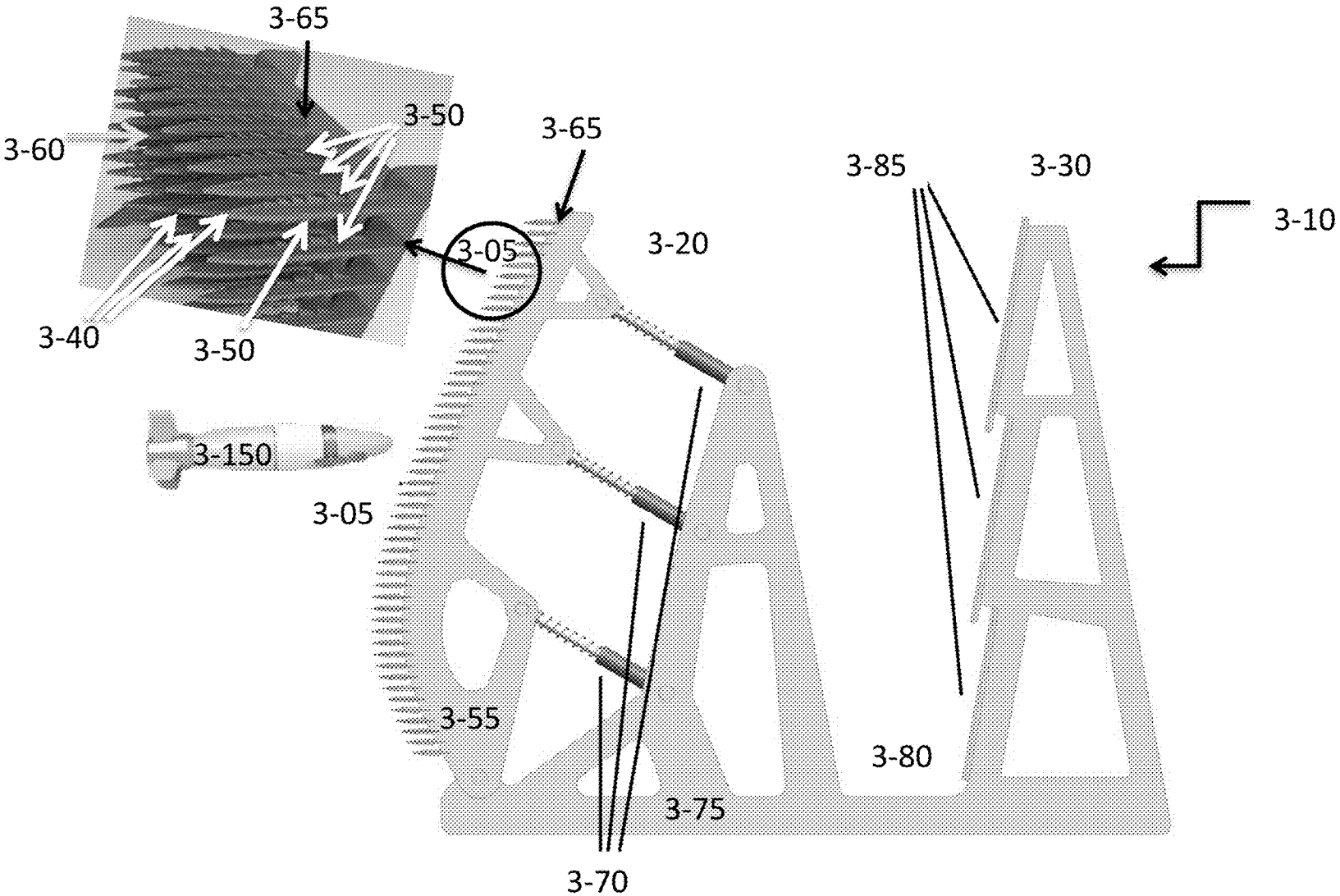
FIG. 3 schematically depicts further embodied aspects of the composite spiked grid- or slat-armored apparatus of this invention in magnified view.

FIG. 3 provides a more detailed schematic depiction of the composite spiked grid- or slat-armored apparatus 3-10 for protection against explosive warhead containing weaponry of this invention. According to this aspect, and in some embodiments, the figure depicts an impact receiving surface, or strike end configured for facing an anticipated impact direction 3-05, which is magnified in the inset in the figure to further highlight structural aspects of same. In the inset, an embodied plurality of slat or bar units arranged in two or more rows 3-65 is shown. The slat or bar units extend along a first longitudinal direction and further comprise sharp protrusions 3-40 extending along an axis substantially perpendicular to the first longitudinal axis. According to this aspect and in some embodiments, the apparatus further comprises a plurality of spiked cross-attachment supports 3-50 connected to and positioned along said plurality of slat or bar units such that a spiked surface of said cross attachment support is positioned substantially perpendicular, as well, to said first longitudinal direction.

Referring still to FIG. 3, as is evident, the sharp protrusions 3-40 extending from the slat or bar units arranged in two or more rows are separated from each other by a first spacing, 3-60.

In some aspects the cross-attachment supports restrict expansion of said first spacing by an incoming explosive warhead containing weapon coming into contact therewith; to that the first spacing 3-60 is not substantially expanded, and the incoming explosive warhead containing weapon may partially insert therewithin.

According to this aspect of the invention and as embodied in the figure, the plurality of slat or bar units and plurality of spiked cross-attachment supports form a trapping array, which trapping array is arranged within a first frame 3-55 movably attached to a second framework structure 3-75, such that said trapping array may move in any lateral direction.

In some aspects, the movable attachment between the first frame and second framework structure comprises spring or piston or other movable 3-70 connections, facilitating movement along a single directional axis.

The composite spiked grid- or slat-armored apparatus further comprises a composite armor plate 3-30 provided at a second spacing 3-80 from the second framework structure 3-75. In some aspects, the composite armor plate comprises staggered or overlapping layers of ceramic pellets or bodies contained within a third frame, to reinforce same.

Figure 4A:
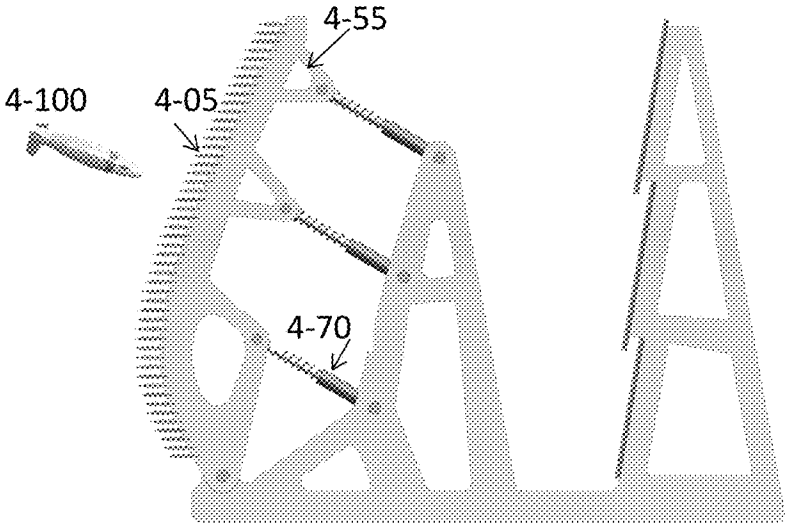
FIGS. 4A-4C schematically another embodied aspect of the composite spiked grid- or slat-armored apparatus, highlighting the potential for the plurality of slat or bar units and the plurality of spiked cross-attachment supports arranged within a first frame movably attached to second framework structure to move in any lateral direction to optimize interaction of the incoming explosive warhead containing weaponry with disruptive elements of the apparatus.
Figure 4B:
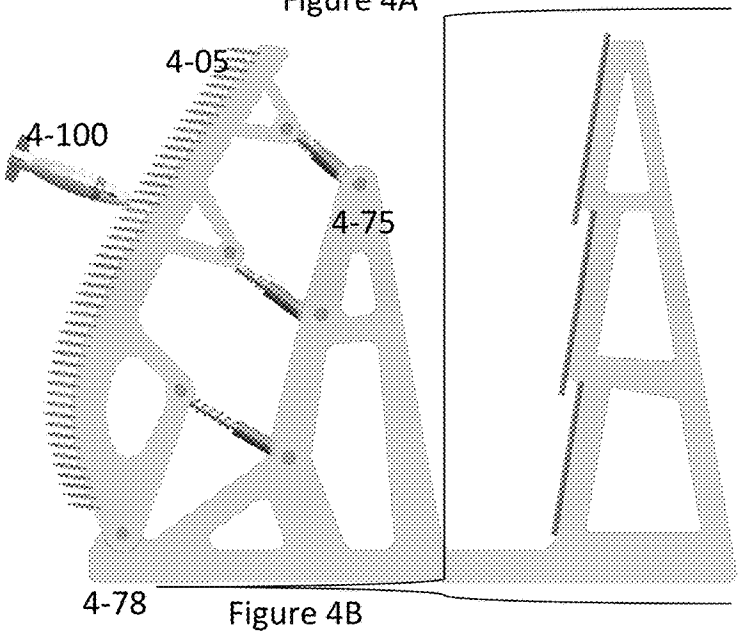
Figure 4C:
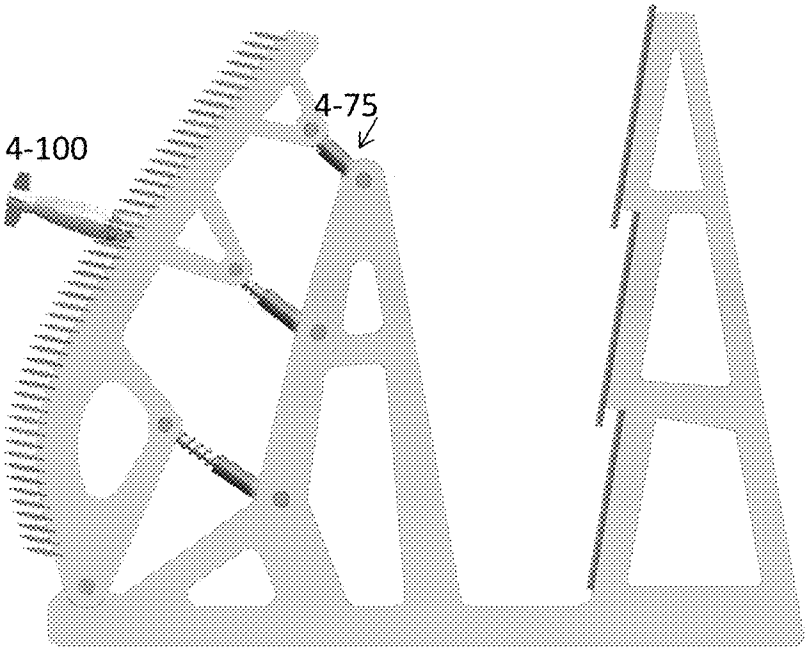

FIGS. 4A-4C schematically depict further embodied aspects of the invention, whereby the benefit of the composite grid- or slat-armored systems of this invention are evident in providing greater protection against an incoming explosive warhead containing weapon.

FIG. 4A depicts an incoming missile 4-150 on a trajectory expected to make contact with the impact receiving surface 4-05 of the spiked grid- or slat-armored apparatus. As is more clearly evident from the embodiment presented in FIG. 4B, the angle of the rows of sharp protrusions 4-40 may differ from the angle of entry of the incoming missile such that the missile may not readily insert within the first spacing optimizing contact with the disruptive elements including the sharp protrusions, but also the spiked cross-attachment supports 4-50. As is depicted in the figure, the array is arranged within a first frame 4-55 movably attached to a second framework structure 4-75, via the spring structures 4-70 so that the trapping array may move in any lateral direction, leading to FIG. 4C, where the incoming missile 4-100 is more effectively brought into contact with the disruptive elements and is thereafter neutralized or reduced in terms of the posed threat from same.

Referring to FIGS. 5A-5D, another embodied impact receiving spiked grid- or slat-armored apparatus is schematically depicted. According to this aspect, the angle of the rows of sharp protrusions 5-40 may differ from the angle of entry of the incoming missile such that the missile may not readily insert within the first spacing optimizing contact with the disruptive elements including the sharp protrusions, but also the spiked cross-attachment supports 4-50. As is depicted in the figure, the array is arranged within a first frame 5-55 movably attached to a second framework structure 5-75, via a movable sliding structure 5-58 in groove 5-59 so that the trapping array may move in a lateral direction. In this aspect, positioning of the array from a 0 to 45 degree angle is shown. As will be appreciated, the second spacing and composite armor plates 4-78 could be similarly positioned as in FIGS. 4A-C and FIG. 3. FIG. 5C and 5D highlight the ability to stagger the length and/or positioning of the protrusions.

Figure 6A:
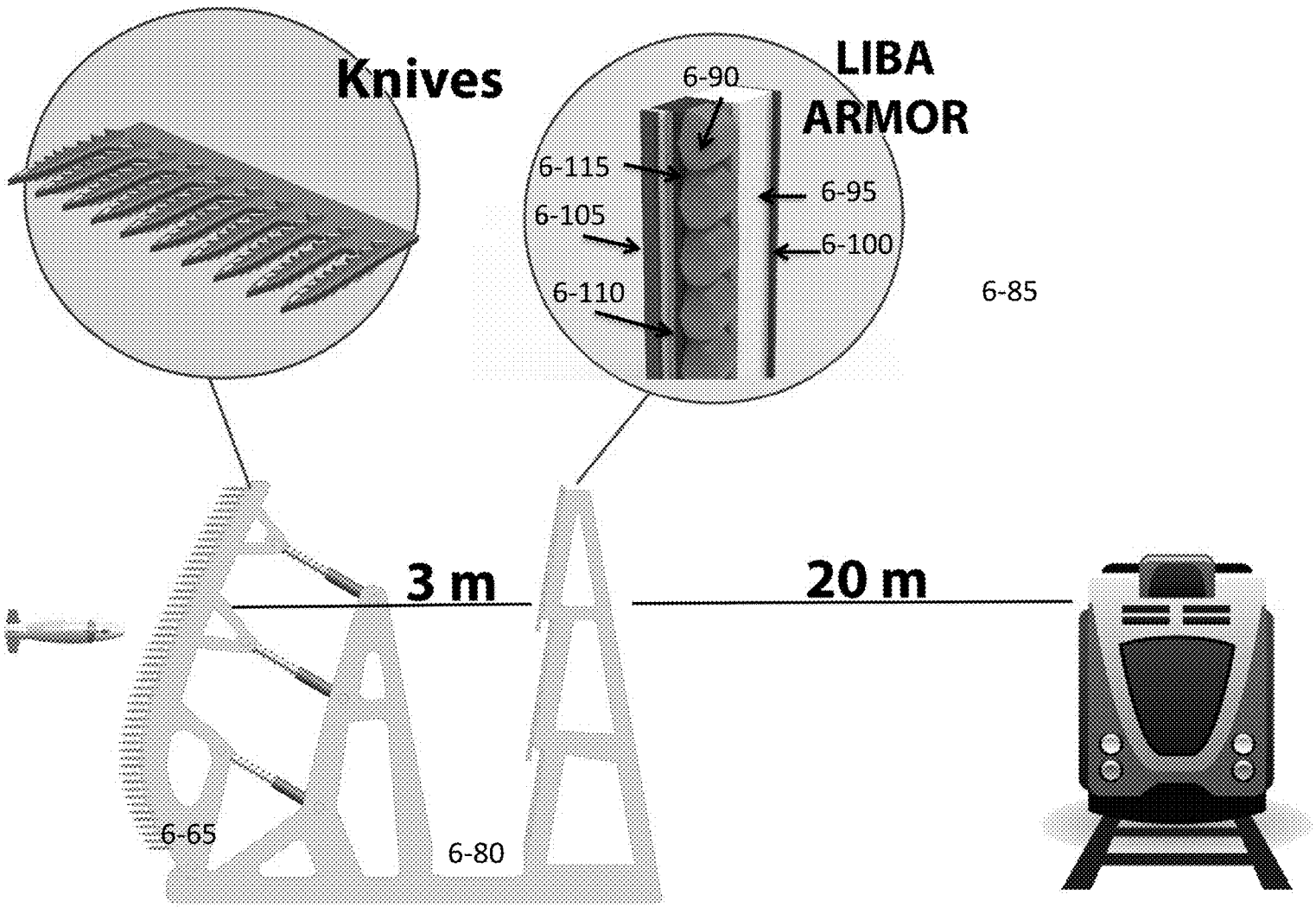
FIGS. 6A-6B schematically depict further embodied aspects of the composite spiked grid- or slat-armored apparatus of this invention in magnified view, highlighting the composite armor plate component.
Figure 6B:
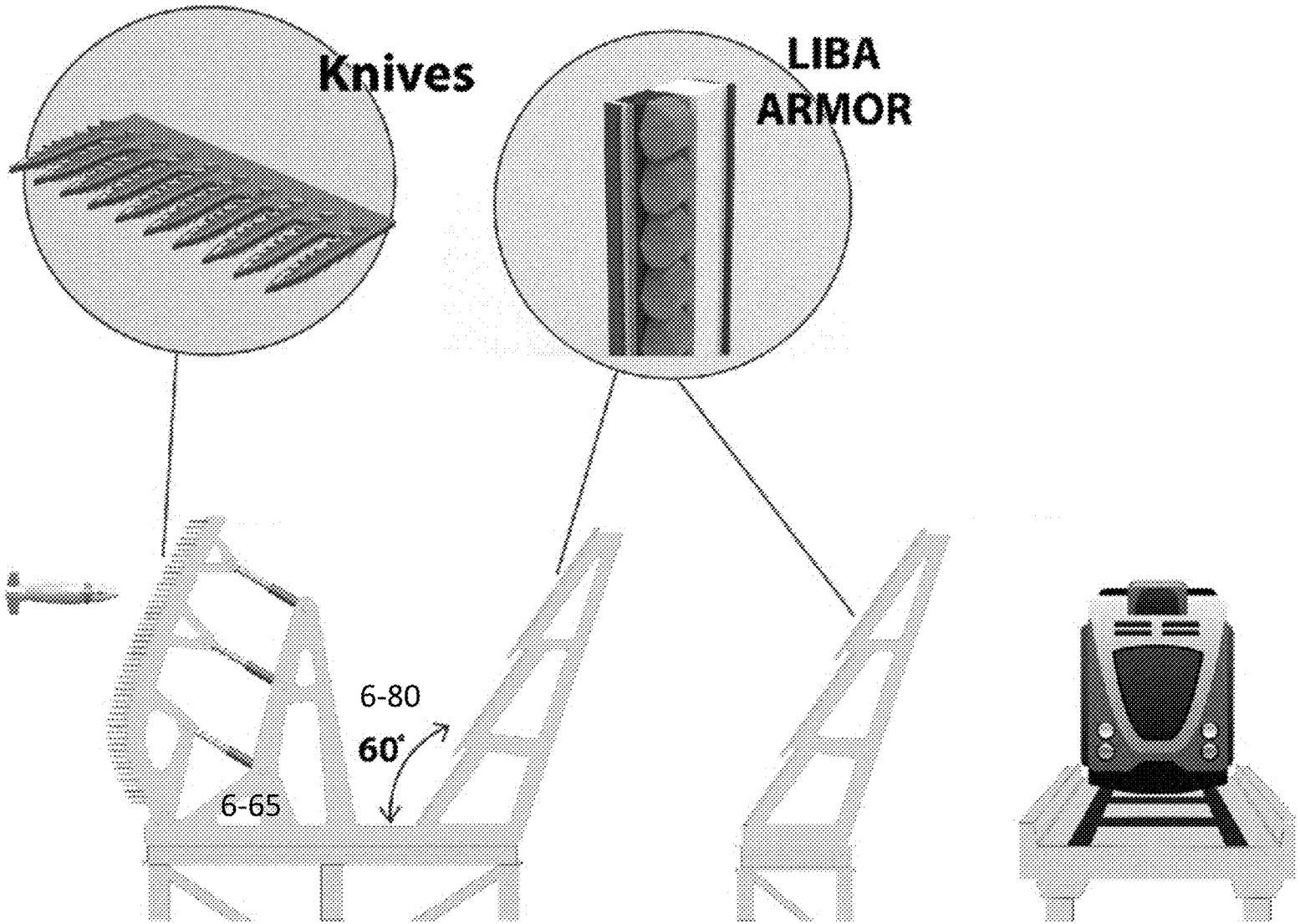

FIG. 6A schematically depicts further embodied aspects of the invention, whereby the arrangement of the ceramic bodies/pellets 6-90 are shown in greater detail. In some aspects the ceramic bodies/pellets 6-90 may be aligned and contained in a matrix 6-115, for example, containing a resin matrix to stabilize and/or orient and/or strengthen same. In some embodiments, the ceramic bodies/pellets 6-90 may abut a further supportive layer 6-95 followed by a strength backing 6-100, which may surround the terminal row (6-110, 6-115) of the ceramic bodies/pellets 6-90.The Figure also describes the scalability of the spiked grid- or slat-armored apparatus, to accommodate a desired structure for protection, such that, for example, as depicted in this embodiment, the first and second combined spacing provides a 3 meter distance from the impact receiving surface to that of the composite armor plate which is placed still at a further distance, e.g. in this embodiment still 20 meters from, the structure being thus protected, which in this embodiment, is the potential location of a train [. FIG. 6B further demonstrates the ability to position yet a further composite armor plate positioning from the impact receiving surface, which may be similarly composed, or may in some embodiments, compose a different type of ballistic armor, or in some embodiments, comprise ceramic bodies/pellets 6-90 containing a different chemical makeup, or in some embodiments, be provided at a different angle, etc.

In some embodiments, the spacing as chosen, as part of the distance and/or periodic repeat and/or height of each of the sharp protrusions may vary as a consequence of the threat assessment for the specific target. In some aspect, the spacing between the sharp protrusions will reflect a consideration of the length of the incoming warhead containing weapon, and in some embodiments, the impact receiving surface of the spiked grid- or slat-armored apparatus, in terms of range may also be a reflection of same to promote arriving at an optimum angle of contact between the incoming warhead containing weapon and the impact receiving surface of the spiked grid- or slat-armored apparatus. In some aspects, such considerations will also reflect a consideration of the size of the target to be protected, its need/potential for mobility, topography of the area, the distance between the armor system and the structure and others, as will be appreciated by the skilled artisan.

Figure 7A:
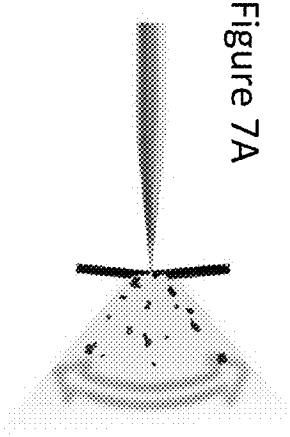
FIGS. 7A-7D depicts blast trajectories in case of detonation of the explosive warhead of incoming explosive warhead containing weapon when engaging various types of and arrangements of armored defensive apparatuses, including the embodied composite grid- or slat-armored system of this invention.
Figure 7B:
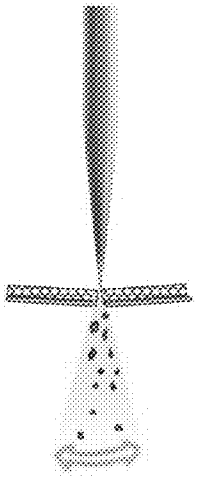
Figure 7C:
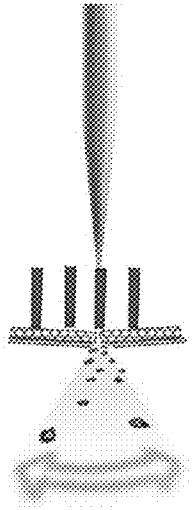
Figure 7D:
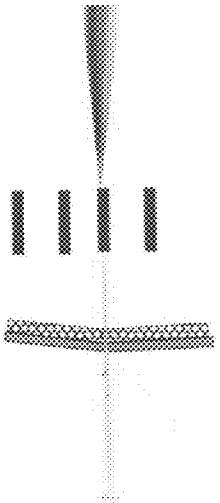

FIGS. 7A-7D schematically depict blast trajectories in case of detonation of the explosive warhead of incoming explosive warhead containing weaponry. FIGS. 7A and 7B depict reduction of the impact of the exploding warhead when armor plates as described herein containing ceramic bodies or pellets are compared to traditional armor. This attenuation seen in FIG. 7B is revered in FIG. 7C when the incoming explosive warhead containing weapon is engaged by a slat structure which is provided so that same is facing the anticipated impact direction, when the armored plate is then located more proximally thereto. Comparing FIG. 7D depicts the surprising finding that when the spacing is sufficient the impact of detonation of the explosive warhead containing weapon bears no impact on the armored plate, providing therefore the most ideal protection for the target structure thereby protected. In some embodiments, if detonation occurs in the instant invention, same is reduced, e.g. when a tandem charge HEAT missile is encountered by damaging at least one of the warheads during its contact with the composite structures of this invention.

FIGS. 8A-8E schematically depict further embodied aspects of the invention, whereby the benefit of the composite grid- or slat-armored systems of this invention are evident when positioned for stationary target structures For example, and representing certain embodiments, protection of antenna systems are envisioned. According to this aspect, and in some embodiments, care is taken to minimize or avoid incorporation of metal or steel components that disrupt signals sent or received by the antenna system while materials robust enough to afford protection in accordance with the design and arrangement of parts as described is maintained. According to this aspect and in some embodiments, the composite grid- or slat-armored systems are constructed to surround critical components of a target to maximize protection of same while reducing the overall weight borne by the structure.

Figures 8A, 8B, 8C, 8D, 8E:
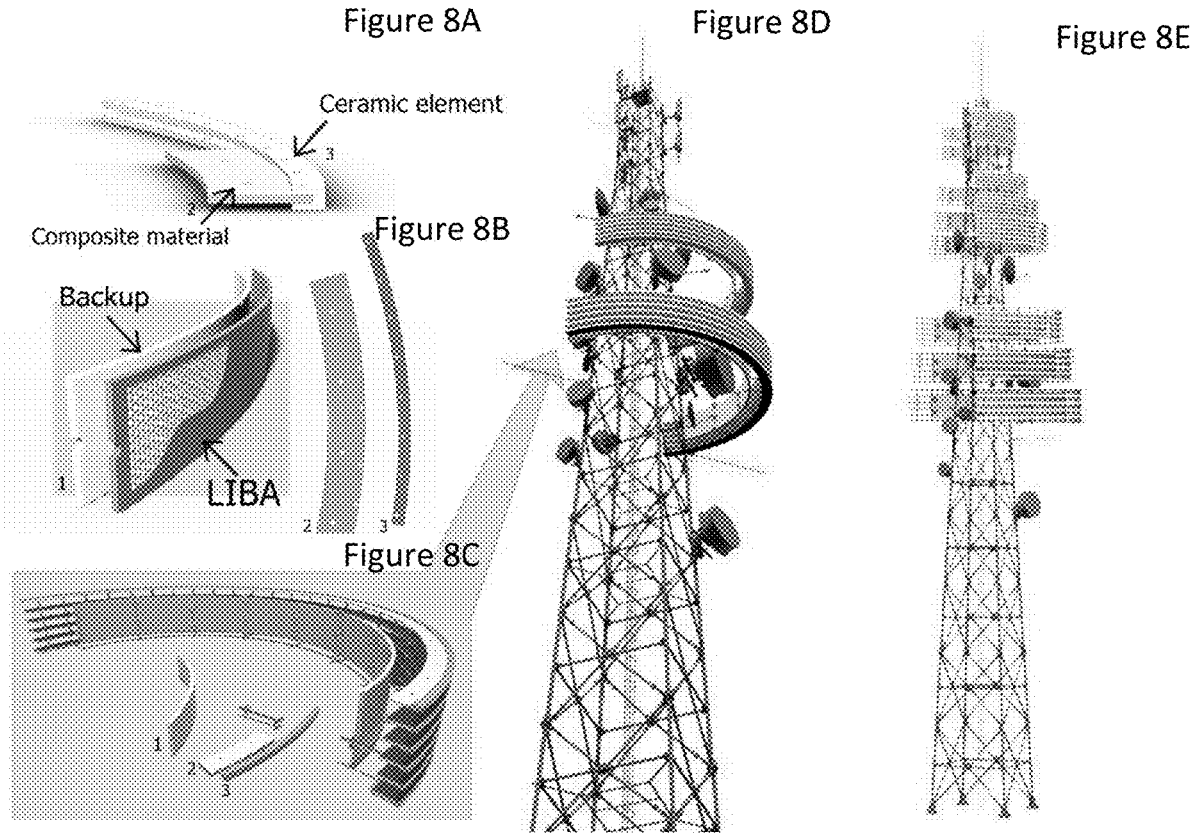
FIGS. 8A-8E schematically depict further embodied aspects of the invention, whereby the benefit of the composite grid- or slat-armored systems of this invention are evident when positioned for stationary target structures.

FIGS. 8D and 8E schematically depict protection of a stationary target structure, in this case a communications antenna, whereby important and sensitive components of same are protected by strategic placement of the composite grid- or slat-armored systems to surround the components of interest only, as opposed to the entire structure, thereby creating a lighter more targeted defense of the target.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

It will be understood by those skilled in the art that various changes in form and details may be made therein without departing from the spirit and scope of the invention as set forth in the appended claims. Those skilled in the art will recognize, or be able to ascertain using no more than routine experimentation, many equivalents to the specific embodiments of the invention described herein. Such equivalents are intended to be encompassed in the scope of the claims.

All publications, patents, and patent applications mentioned herein are hereby incorporated by reference in their entirety as if each individual publication or patent was specifically and individually indicated to be incorporated by reference. In case of a conflict between the specification and an incorporated reference, the specification shall control. Where number ranges are given in this document, endpoints are included within the range. Furthermore, it is to be understood that unless otherwise indicated or otherwise evident from the context and understanding of one of ordinary skill in the art, values that are expressed as ranges can assume any specific value or subrange within the stated ranges, optionally including or excluding either or both endpoints, in different embodiments of the invention, to the tenth of the unit of the lower limit of the range, unless the context clearly dictates otherwise. Where a percentage is recited in reference to a value that intrinsically has units that are whole numbers, any resulting fraction may be rounded to the nearest whole number.

In the claims articles such as "a,", "an" and "the" mean one or more than one unless indicated to the contrary or otherwise evident from the context. Claims or descriptions that include "or" or "and/or" between members of a group are considered satisfied if one, more than one, or all of the group members are present in, employed in, or otherwise relevant to a given product or process unless indicated to the contrary or otherwise evident from the context. The invention includes embodiments in which exactly one member of the group is present in, employed in, or otherwise relevant to a given product or process. The invention also includes embodiments in which more than one, or all of the group members are present in, employed in, or otherwise relevant to a given product or process. Furthermore, it is to be understood that the invention provides, in various embodiments, all variations, combinations, and permutations in which one or more limitations, elements, clauses, descriptive terms, etc., from one or more of the listed claims is introduced into another claim dependent on the same base claim unless otherwise indicated or unless it would be evident to one of ordinary skill in the art that a contradiction or inconsistency would arise. Where elements are presented as lists, e.g. in Markush group format or the like, it is to be understood that each subgroup of the elements is also disclosed, and any element(s) can be removed from the group. It should it be understood that, in general, where the invention, or aspects of the invention, is/are referred to as comprising particular elements, features, etc., certain embodiments of the invention or aspects of the invention consist, or consist essentially of, such elements, features, etc. For purposes of simplicity those embodiments have not in every case been specifically set forth in haec verba herein. Certain claims are presented in dependent form for the sake of convenience, but Applicant reserves the right to rewrite any dependent claim in independent format to include the elements or limitations of the independent claim and any other claim(s) on which such claim depends, and such rewritten claim is to be considered equivalent in all respects to the dependent claim in whatever form it is in (either amended or unamended) prior to being rewritten in independent format.

The following examples describe certain embodiments of the invention and and should not be construed as limiting the scope of what is encompassed by the invention in any way.

EXAMPLES

Materials and Methods

Example 1

Construction of Embodied Composite Spiked Grid- or Slat-Armored Apparatuses

It will be understood by the skilled artisan how to construct and produce the composite spiked grid- or slat-armored apparatuses as herein described.

For example and in some embodiments, elements of the frames, slat or bar units and spiked cross-attachment supports can be prepared as a single integral body, or the various elements may be provided by any of the following: bolting, welding, external wrapping and other methods as known to the artisan.

In some aspects, the spacing between the slat or bar units will be chosen to be larger than the dimensions of a detonator of an explosive warhead containing weaponry assessed as a potential threat for a given target, while also being smaller than the rough diameter of the war head. Other considerations include assessing the optimum spacing between the impact receiving trapping array and composite armor plate as well as assessing the optimum angle of contact between the explosive warhead containing weaponry and the impact receiving trapping array.

The composite armor plate may be prepared by any of the methods as described in U.S. Pat. Nos. 5,763,813, 5972819, 6203908, 6,112,635, 6,408,734, 6,289,781, 6,624,106, 6,575,075, 6,497,966, 6,860,186, 7,117,780, 7,603,939, 8281700, 8,012,897, 7,383,762, or 7,402,541, each and every one of which is hereby incorporated herein in its entirety, which in turn may be attached to the larger apparatus via, bolting, welding, etc., as will be appreciated by the skilled artisan.

Example 2

Superior Protection Afforded by the Composite Spiked Grid- or Slat-Armored Apparatus of This Invention In some aspects of this invention, the composite spiked grid- or slat-armored apparatuses provide superior protection from explosive warhead containing weaponry. Such superior performance is demonstrated by multiple means known in the art. For example, such superior performance is demonstrated following comparison of same versus other protective structures, whereby both the control and embodied apparatus are exposed to a controlled explosion of a rocket positioned at the impact receiving surface of each. Following controlled explosion, each apparatus is assessed for its structural integrity including analysis of the various components of each apparatus.

The following experimental information is provided as illustrative of principles of operation of the invention but are by no means to be taken to in any way so as to limit the scope of the invention. The examples and accompanying figures are in this sense for illustrative purposes only and while same may represent some embodiments of the invention other comparable structures and components consistent with the full range and scope as described herein may be substituted and achieve the desired and described effects herein.

Figure 9A:
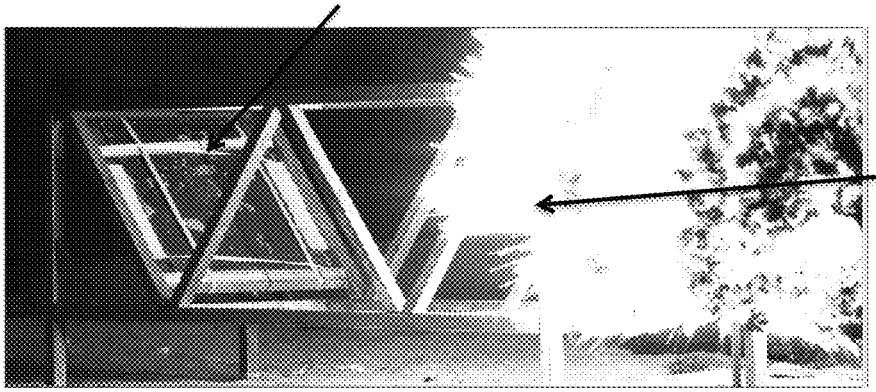
FIG. 9A-9B depicts a blast trajectory in case of detonation of an incoming explosive warhead containing weapon when engaging an armored defensive apparatus (9-20), when the detonation is in sufficient proximity to a typical armored defensive apparatus (9-20), nonetheless, the jet (9-30) propelled from the shaped charge detonation (9-10) penetrates the armored defensive apparatus (9-20).
Figure 9B:
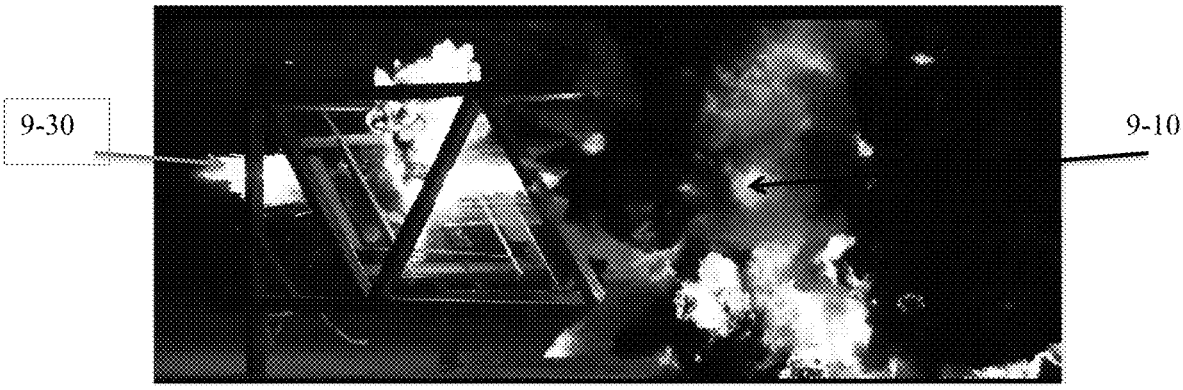

As described with respect to FIGS. 7A-7D hereinabove, blast trajectories in the case of detonation of an explosive warhead of incoming explosive warhead containing weaponry can be reduced when armor plates as described herein containing ceramic bodies or pellets are positioned to receive the impact of the exploding warhead. FIG. 9A depicts the blast trajectory when detonation 9-10 of an incoming explosive warhead-containing weapon is proximal to the impact receiving surface of the armor plate 9-20, whereby the shaped charge jet 9-30 propelled from the blast penetrates the armor as seen in FIG. 9B.

Figure 10A:
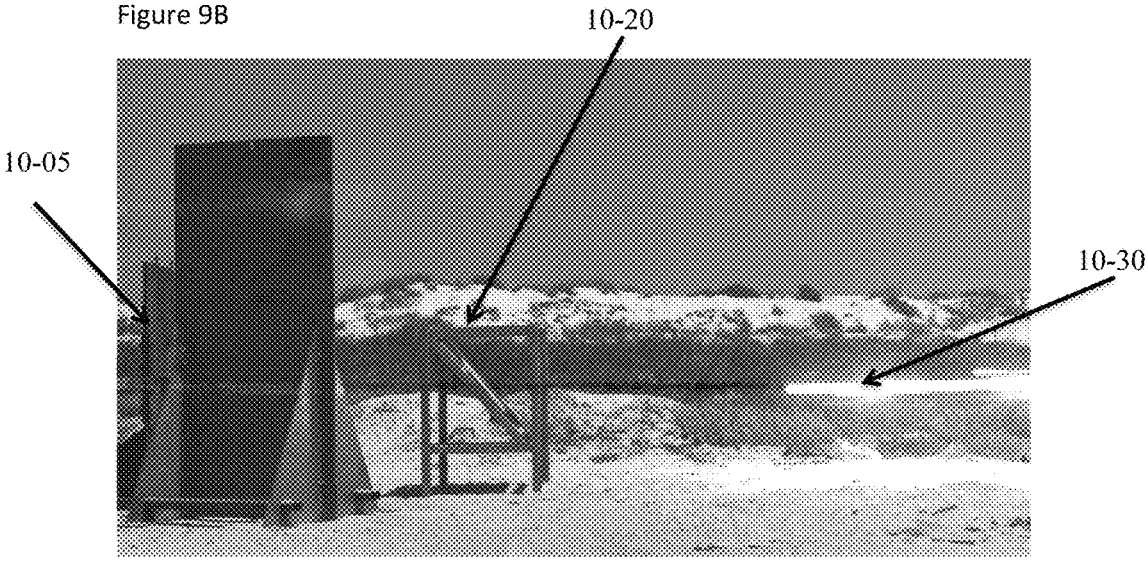
FIGS. 10A-10D depicts the principle of an embodied method of this invention, whereby a target structure (10-05) may be protected against explosive warhead containing weaponry by providing a protective apparatus 10-20 positioned to be facing an anticipated impact direction from a jet (10-30) propelled from a shaped charge detonation, where the protective apparatus is positioned at a spacing from the target direction, and from the area immediately proximal to detonation so that the protective apparatus absorbs the impact (10-25) of the propelled jet.
Figure 10B:
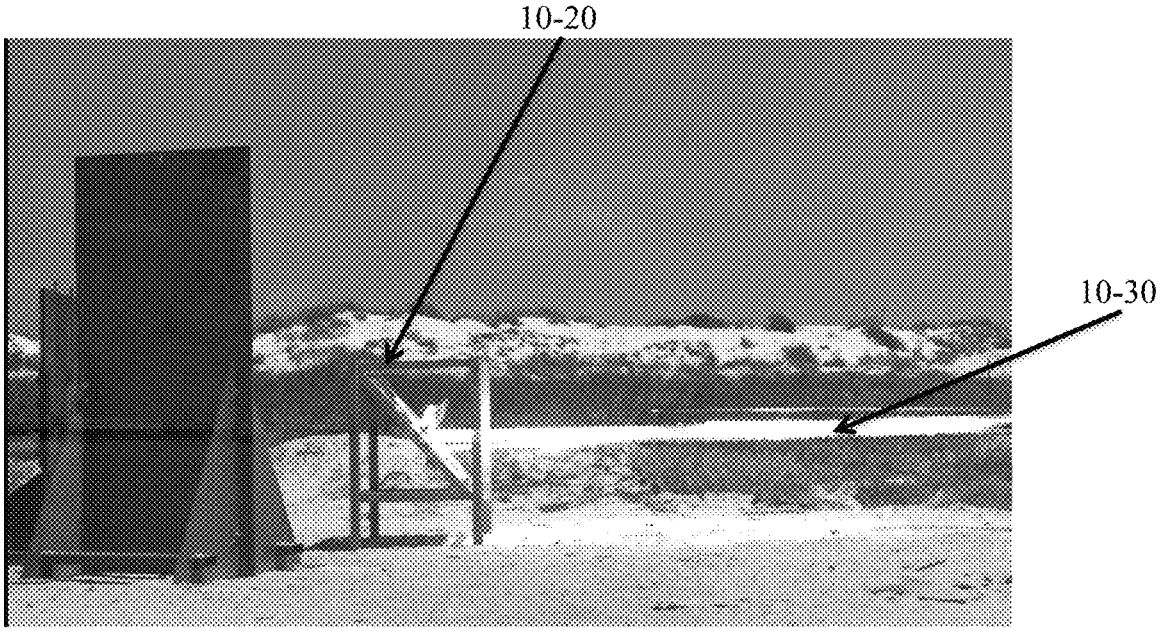
Figure 10C:
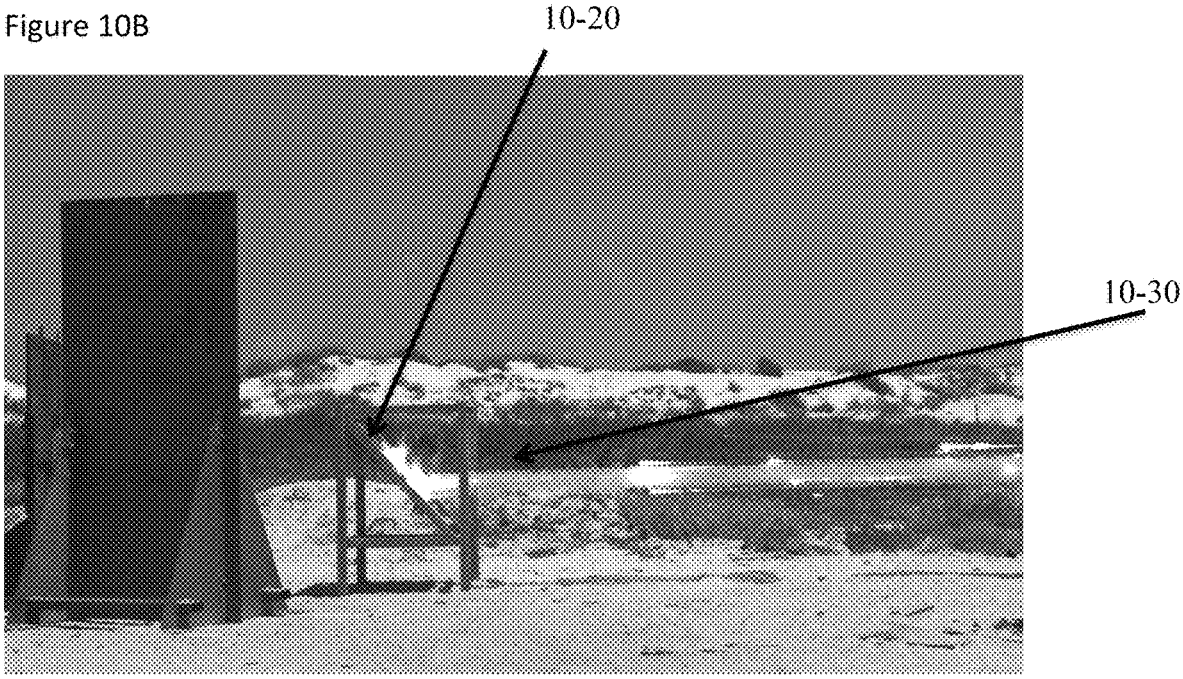
Figure 10D:
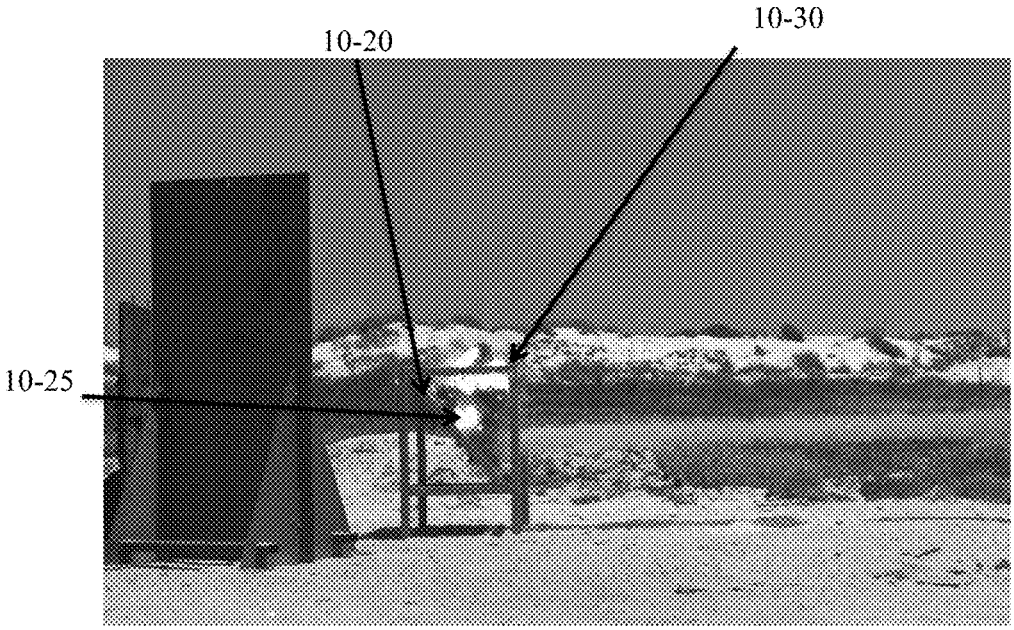

Reduction of the impact/damage from the blast trajectory can be achieved if the armor plates are positioned at a sufficient spacing from both the shaped charge point of detonation and from the target being defended by the plate-containing structure. As is evident from FIGS. 10A-10D, a target structure (10-05) may be protected against a shaped charge containing explosive warhead when the jet (10-30) origin is at a sufficient distance from the plate-containing structure so that the plate-containing structure absorbs the impact (10-25) of the propelled jet. FIG. 10D shows that the plate-containing structure absorbed essentially all of the impact of the blast.

Figure 11A:
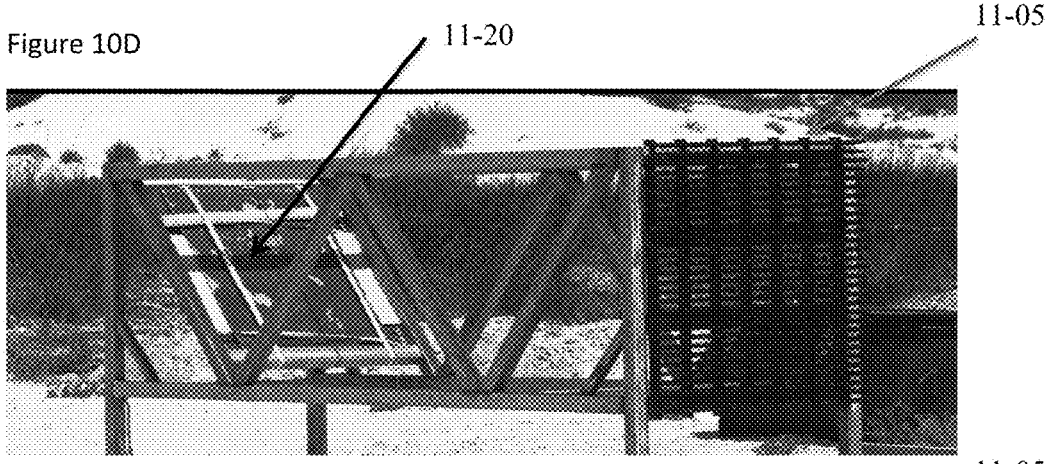
FIG. 11A-11I depicts an embodied composite spiked grid- or slat-armored apparatus of this invention, wherein the trapping array (11-05) is positioned at a spacing from the composite armor plate 11-20, which optionally may be angled and the incoming shaped-charge containing weapon (11-100) engages the trapping array resulting in the structural compromise of the weapon, optionally resulting in the detonation of same (as initially seen in FIG. 11C), whereby a full blast is evident in panels 11D-G, however, no jet is propelled from the shaped charge detonation and as a result there is no structural compromise to the composite armor plate despite the significant blast generated at the trapping array, and minimal damage to the trapping array is seen.
Figure 11B:
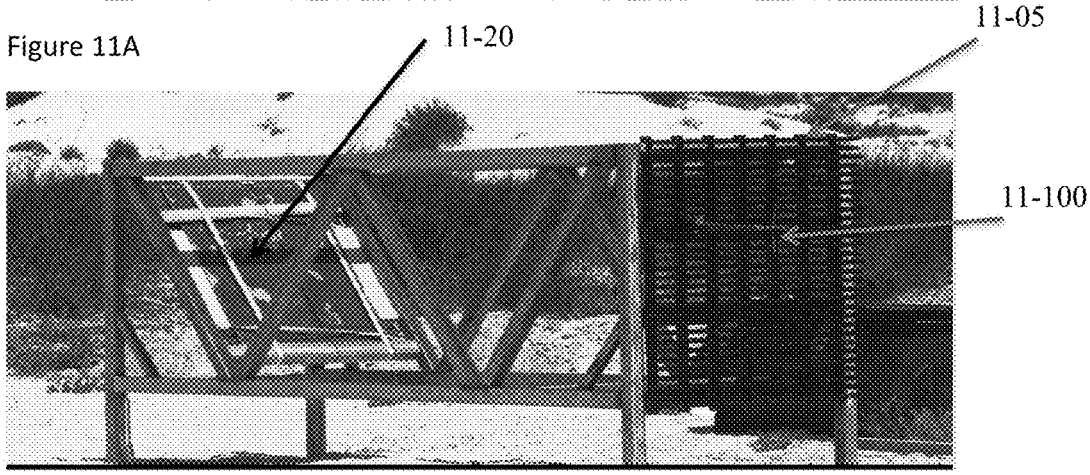
Figure 11C:
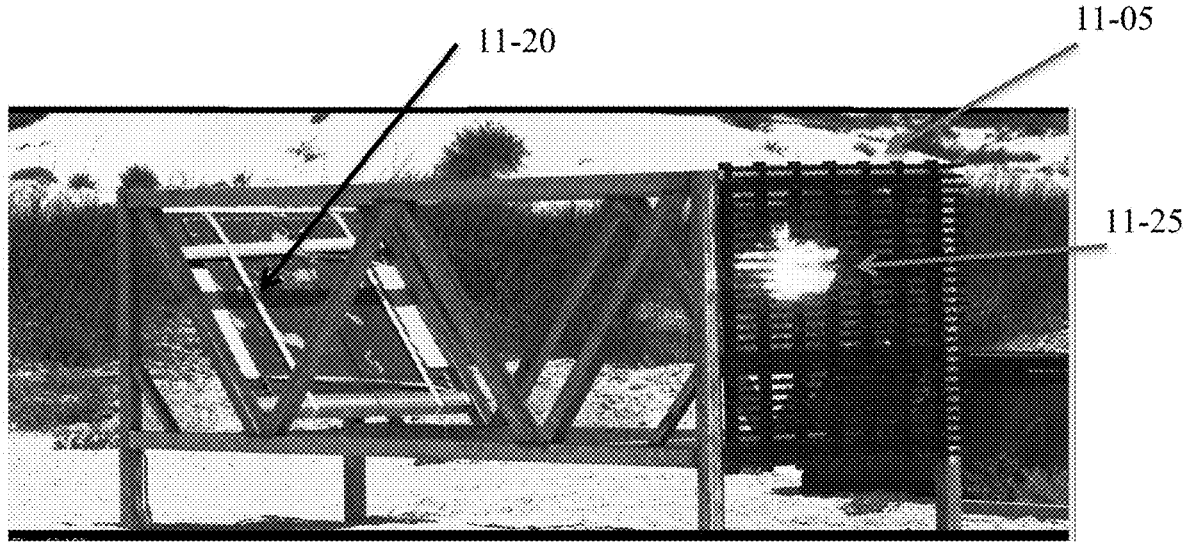
Figure 11D:
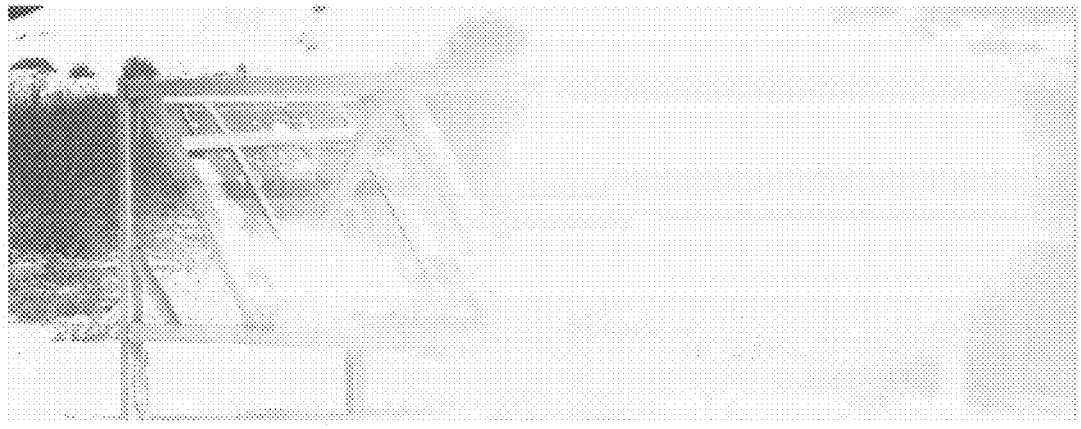
Figure 11E:
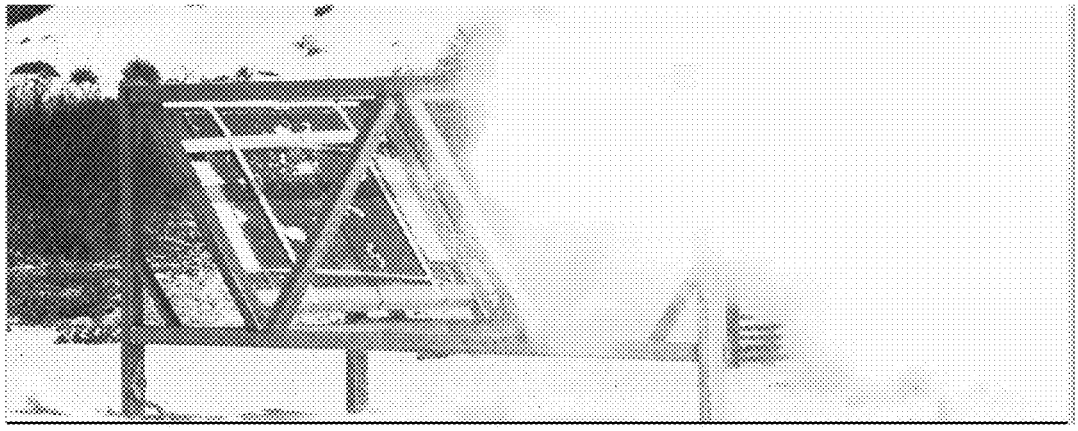
Figure 11F:
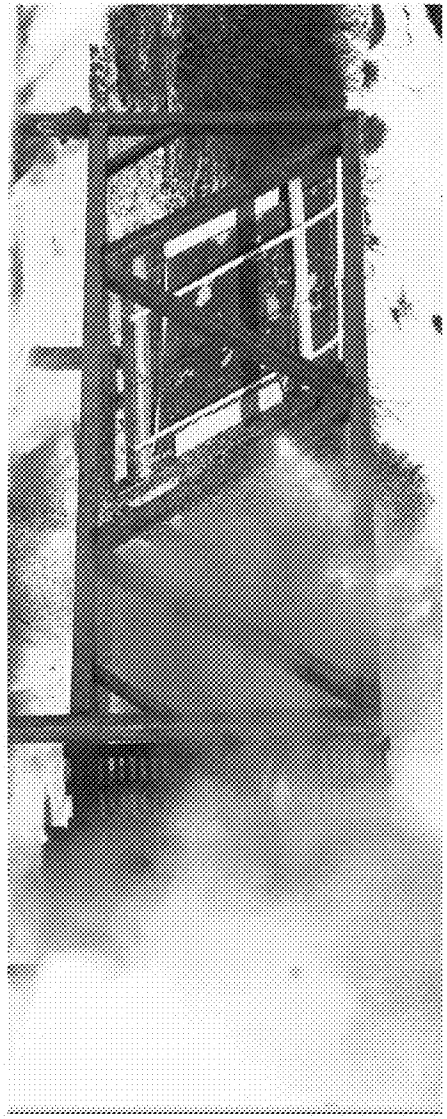
Figure 11G:
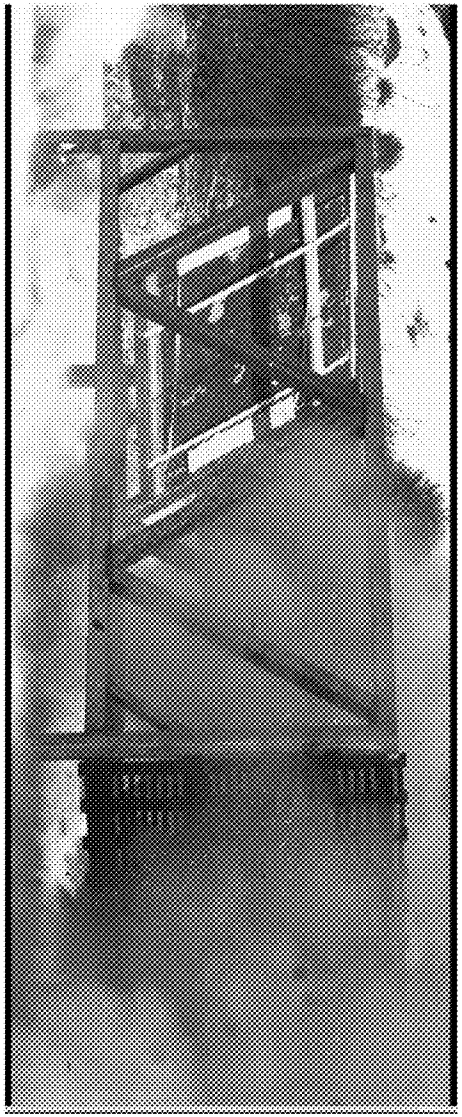
Figure 11H:
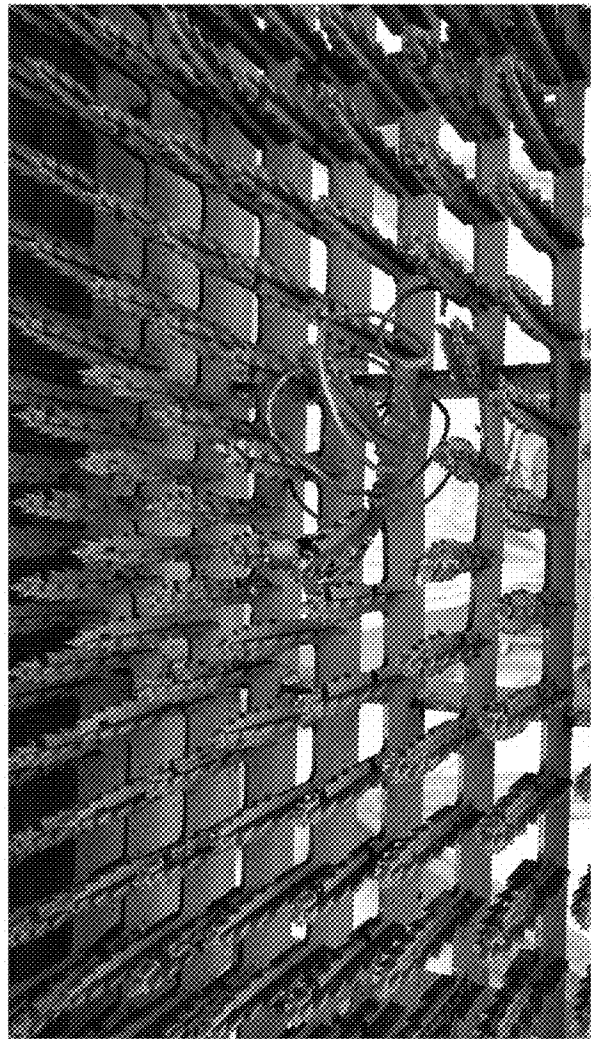
Figure 11I:
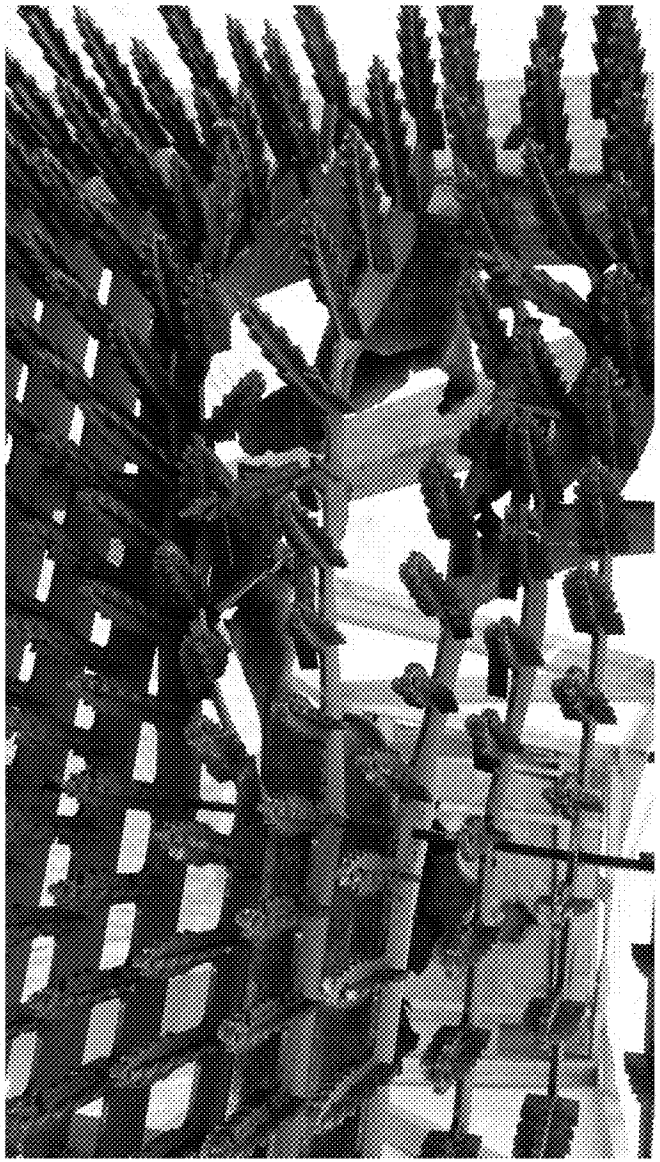

FIGS. 11A-11G are video frames depicting a further experiment conducted where an illustrative embodied composite spiked grid- or slat-armored apparatus of this invention is evaluated. The trapping array (11-05) was positioned at a spacing from the composite armor plate 11-20, and the incoming shaped-charge containing weapon (11-100) engaged the trapping array (11-25) resulting in the structural compromise of the weapon. FIGS. 10D-10E show an enormously powerful blast detonation nonetheless when the incoming shaped-charge containing weapon was structurally compromised. Such structural compromise is evident as no blast-generated penetrating jet was propelled from the shaped charge detonation and as a result there is no structural compromise to the composite armor plate despite the significant blast generated at the trapping array. FIGS. 11F and 11G show that as the explosion dissipates, it can be seen that no damage was inflicted on the composite armor plate and any target structure being protected thereby would be unaffected by the engagement of the shaped-charge containing weapon with the embodied spiked grid- or slat-armored apparatus depicted herein. FIG. 11H and 11I are photographs of the trapping array subj ected to the detonation as depicted in the video frames shown in FIGS. 11A-11G. The photographs depict different regions of the grid, where limited damage to the trapping array, which effectively neutralized and compromised the structural integrity of the weapon.

What is claimed is:

1. A composite spiked grid- or slat-armored apparatus for protection against explosive warhead containing weaponry, comprising a plurality of slat or bar units arranged in two or more rows, each of said plurality of slat or bar units extending along a first longitudinal direction and including: a strike end configured for facing an anticipated impact direction, comprising sharp protrusions separated from each other by a first spacing, and a plurality of spiked cross-attachment supports connected to and positioned along said plurality of slat or bar units such that a spiked surface of said cross attachment support is positioned substantially perpendicular to said first longitudinal direction, wherein said cross-attachment supports restrict expansion of said first spacing by an incoming explosive warhead containing weapon coming into contact therewith;

wherein said plurality of slat or bar units and said plurality of spiked cross-attachment supports form a trapping array, which trapping array is optionally arranged within a first frame movably attached to second framework structure, such that said trapping array may move in any lateral direction; and said trapping array is provided at a spacing from a target in need of protection against explosive warhead containing weaponry;

wherein said sharp protrusions comprise laterally extending spikes extending in a direction substantially parallel to the first longitudinal direction and substantially perpendicular to said impact direction; and wherein said cross attachment supports comprise laterally extending spikes extending in a direction substantially perpendicular to the first longitudinal direction and substantially perpendicular to said impact direction.

2. The composite spiked grid- or slat-armored apparatus of claim 1, wherein said first spacing between adjacent slat or bar units in said array is from about 10% to about 70% less in size than a diameter of an incoming explosive warhead containing weaponry.

3. The composite spiked grid- or slat-armored apparatus of claim 1, wherein said slat or bar units, or said spiked cross-attachment supports, or a combination thereof are composed of various materials selected from the group consisting of: metals, ceramics, composites, and combinations thereof.

4. The composite spiked grid- or slat-armored apparatus of claim 1, wherein said spiked cross-attachment supports contain sharp extending projections.

5. The composite spiked grid- or slat-armored apparatus of claim 4, wherein said sharp extending projections may vary in terms of number, spacing, periodicity, angle, length, shape or a combination thereof.

6. The composite spiked grid- or slat-armored apparatus of claim 1, wherein said slat or bar units, or said spiked cross-attachment supports, or a combination thereof are of various cross sections.

7. The composite spiked grid- or slat-armored apparatus of claim 1, wherein said slat or bar units, or said spiked cross-attachment supports, or a combination thereof are of various shapes selected from the group consisting of: rectangles, trapezoids, triangles, ovals, and cylinders.

8. The composite spiked grid- or slat-armored apparatus of claim 1, wherein cross-attachment members are attached by methods selected from the group consisting of: tying, wrapping, braiding, gluing, welding, adhesion, fasteners, screws, nubs, clips, bands, and any combination thereof.

9. The composite spiked grid- or slat-armored apparatus of claim 1, further comprising attachments that pass around the parallel bars, attachments that pass through holes in the parallel bars, perpendicular parallel bar-to-parallel bar attachments, X-shaped attachments, attachments between every other parallel bar, or any combination thereof.

10. The composite spiked grid- or slat-armored apparatus of claim 1, further comprising a reinforced structure provided at a second spacing from said second framework structure, said composite armor plate comprising i. a layer of a plurality of high density alumina ceramic bodies, each of said bodies being substantially cylindrical in shape, with at least one convexly curved end face, and each of said bodies having a major axis substantially perpendicular to the axis of its respective curved end face, wherein the ratio D/R between the diameter D of each of said cylindrical bodies and the radius R of curvature of the respectively convexly curved end face of each of said bodies is at least 0.64:1, and wherein said bodies are arranged in a plurality of adjacent rows and columns, the major axis of said bodies being in substantially parallel orientation with each other and substantially perpendicular to an adjacent surface of said panel; or a single internal layer of pellets made of ceramic material disposed in a plurality of spaced-apart rows and columns, which are bound and retained in plate form by an elastic material;

a majority of said pellets having at least one convexly curved end face; an outer impact receiving major surface defined by said convexly curved end faces of said pellets for absorbing and dissipating kinetic energy from high-velocity projectiles; said convexly curved end faces of said pellets receiving impact from high-velocity projectiles and absorbing and dissipating kinetic energy therefrom; said pellets having a substantially regular polygonal outer surface with the corners of the polygon being eliminated to form rounded corners; a majority of each of said pellets being in direct contact with six adjacent pellets in the same layer to provide mutual lateral confinement there between to trap said high-velocity projectiles; a valley space being defined between three adjacent pellets, said valley space being substantially smaller than a valley space defined by three cylindrical pellets having a diameter the same as said polygonal pellets with rounded corners; and a plurality of said pellets defining an opening extending into said pellet from a surface opposite to said outer impact receiving convexly cured end face of said pellet to reduce the weight per area thereof.

11. The composite spiked grid- or slat-armored apparatus of claim 10, wherein the one of the first and second end faces of said ceramic pellets is disposed substantially opposite to the outer impact receiving major surface and is spherical.

12. The composite spiked grid- or slat-armored apparatus of claim 10, wherein the one of the first and second end faces of said ceramic pellets is disposed opposite said impact receiving major surface and is convexly curved and wherein a ratio D/R between the diameter of the body and a radius of curvature of the one of the first and second end faces disposed opposite said outer impact receiving major surface is between about 0.28:1 and 0.639:1.

13. The composite spiked grid- or slat-armored apparatus of claim 10, wherein the one of the first and second end faces of said ceramic pellets disposed substantially opposite to the outer impact receiving major surface is in a form of an outwardly tapered truncated cone.

14. The composite spiked grid- or slat-armored apparatus of claim 10, wherein a majority of said pellets have at least one convexly-curved end face oriented to substantially face in a direction of the outer impact receiving major surface.

15. The composite spiked grid- or slat-armored apparatus of claim 10, wherein said pellets have at least one axis of at least 9 mm.

16. The composite spiked grid- or slat-armored apparatus of claim 10, wherein said pellets have at least one axis of at least 20 mm.

17. The composite spiked grid- or slat-armored apparatus of claim 10, wherein each of said pellets is formed of a ceramic material selected from the group consisting of sintered oxide, nitrides, carbides and borides of alumina, magnesium, zirconium, tungsten, molybdenum, titanium and silica.

18. The composite spiked grid- or slat-armored apparatus of claim 10, wherein each of said pellets is formed of a material selected from the group consisting of alumina, boron carbide, boron nitride, titanium diboride, silicon carbide, silicon oxide, silicon nitride, magnesium oxide, silicon aluminum oxynitride and mixtures thereof.

19. The composite spiked grid- or slat-armored apparatus of claim 10, wherein a plurality of said pellets have a channel extending inwardly from said one of the first and second end faces disposed opposite said outer impact receiving major surface to reduce the weight per area thereof.

20. The composite spiked grid- or slat-armored apparatus of claim 1, wherein said target in need of protection against explosive warhead containing weaponry is a bridge, a communications structure or plant, a building, a reactor or other sensitive stationary target.

21. A method of protecting a target against explosive warhead containing weaponry, said method comprising providing the composite spiked grid- or slat-armored apparatus of claim 1 positioned to be facing an anticipated impact direction at a spacing from said target in need of protection.

22. A method of protecting a bridge against explosive warhead containing weaponry, said method comprising providing the composite spiked grid- or slat-armored apparatus of claim 1, positioned to be facing an anticipated impact direction at a spacing from said bridge, wherein said composite spiked grid- or slat-armored apparatus absorbs the impact of said explosive warhead containing weaponry.

23. The method of claim 22, wherein said composite spiked grid- or slat-armored apparatus is supported on a framework that is independently secured and does not rely on load bearing supports of said bridge.

* * * * *